US005108254A

United States Patent [19]

Go

[11] Patent Number: 5,108,254

[45] Date of Patent: Apr. 28, 1992

[54] METHOD FOR CONTROLLING A VEHICLE PARKING STRUCTURE

[76] Inventor: Junichi Go, 2510-11, Nagara, Gifu-shi, Gifu-ken, Japan

[21] Appl. No.: 538,272

[22] Filed: Jun. 14, 1990

Related U.S. Application Data

[62] Division of Ser. No. 56,598, May 29, 1987, Pat. No. 4,950,117.

[30] Foreign Application Priority Data

| | | | |
|---|---|---|---|
| Oct. 8, 1985 | [JP] | Japan | 60-224585 |
| May 8, 1986 | [JP] | Japan | 61-105653 |
| May 8, 1986 | [JP] | Japan | 61-105654 |
| May 13, 1986 | [JP] | Japan | 61-109005 |
| May 13, 1986 | [JP] | Japan | 61-109006 |
| May 20, 1986 | [JP] | Japan | 61-115675 |
| May 30, 1986 | [JP] | Japan | 61-126303 |
| Jun. 10, 1986 | [JP] | Japan | 61-134549 |
| Sep. 12, 1986 | [JP] | Japan | 61-216684 |

[51] Int. Cl.[5] ..... E04H 6/06

[52] U.S. Cl. ..... 414/786; 414/275; 414/231; 414/252

[58] Field of Search ..... 414/261, 262, 264, 252, 414/253, 254, 255, 256, 241, 231, 232, 234, 227, 228, 286, 284, 282, 279, 273, 274, 269, 266, 267, 786, 275

[56] References Cited

U.S. PATENT DOCUMENTS

| | | | |
|---|---|---|---|
| 1,114,975 | 10/1914 | Fessenden | 414/235 |
| 2,285,232 | 6/1942 | Sheehan | 414/264 |
| 2,598,750 | 6/1952 | Bargehr | 414/262 X |
| 3,063,580 | 11/1962 | Dierks | 414/243 |
| 3,675,799 | 7/1972 | Steed et al. | 414/240 |
| 3,984,012 | 10/1976 | Ennis et al. | 414/231 |
| 4,265,581 | 5/1981 | Ives et al. | 414/243 X |

FOREIGN PATENT DOCUMENTS

| | | | |
|---|---|---|---|
| 1107720 | 8/1955 | France | 414/243 |
| 80774 | 3/1974 | Japan | 414/240 |

*Primary Examiner*—Frank E. Werner
*Attorney, Agent, or Firm*—Arnold, White & Durkee

[57] ABSTRACT

There are defined a lift space (E) and multi-storied housing spaces (X,Y) provided on at least one side out of the left side, right side, front, side, and rear side of the lift space (E). A three dimensional housing apparatus comprises a liftable fork unit composed of a pair of liftable forks (5a,5b) movable up and down in the lift space (E), and a plurality of traversable housing forks (20) each reciprocatingly movable between a corresponding housing space (X,Y) and the lift space (E). An object (C) to be housed can speedily and safely be warehoused in and delivered from a respective housing space (X,Y) by the liftable fork unit (5a,5b) and respective traversable housing fork (20).

6 Claims, 36 Drawing Sheets

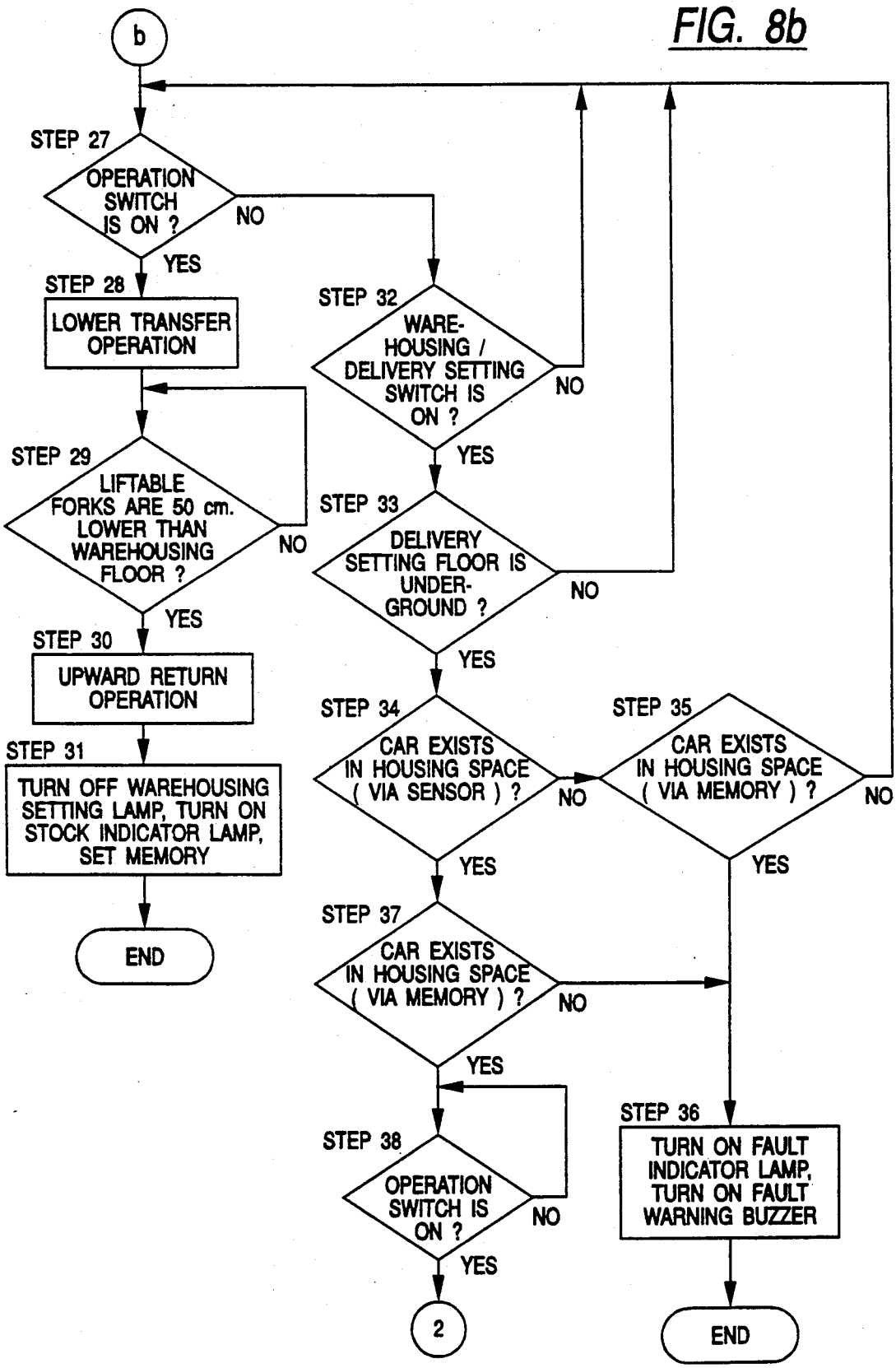
FIG. 8b
b
STEP 27
OPERATION SWITCH IS ON ?
NO
YES
STEP 28
LOWER TRANSFER OPERATION
STEP 29
LIFTABLE FORKS ARE 50 cm. LOWER THAN WAREHOUSING FLOOR ?
NO
YES
STEP 30
UPWARD RETURN OPERATION
STEP 31
TURN OFF WAREHOUSING SETTING LAMP, TURN ON STOCK INDICATOR LAMP, SET MEMORY
END
STEP 32
WARE-HOUSING / DELIVERY SETTING SWITCH IS ON ?
NO
YES
STEP 33
DELIVERY SETTING FLOOR IS UNDER-GROUND ?
NO
YES
STEP 34
CAR EXISTS IN HOUSING SPACE ( VIA SENSOR ) ?
NO
YES
STEP 35
CAR EXISTS IN HOUSING SPACE ( VIA MEMORY ) ?
NO
YES
STEP 37
CAR EXISTS IN HOUSING SPACE ( VIA MEMORY ) ?
NO
YES
STEP 38
OPERATION SWITCH IS ON ?
NO
YES
2
STEP 36
TURN ON FAULT INDICATOR LAMP, TURN ON FAULT WARNING BUZZER
END

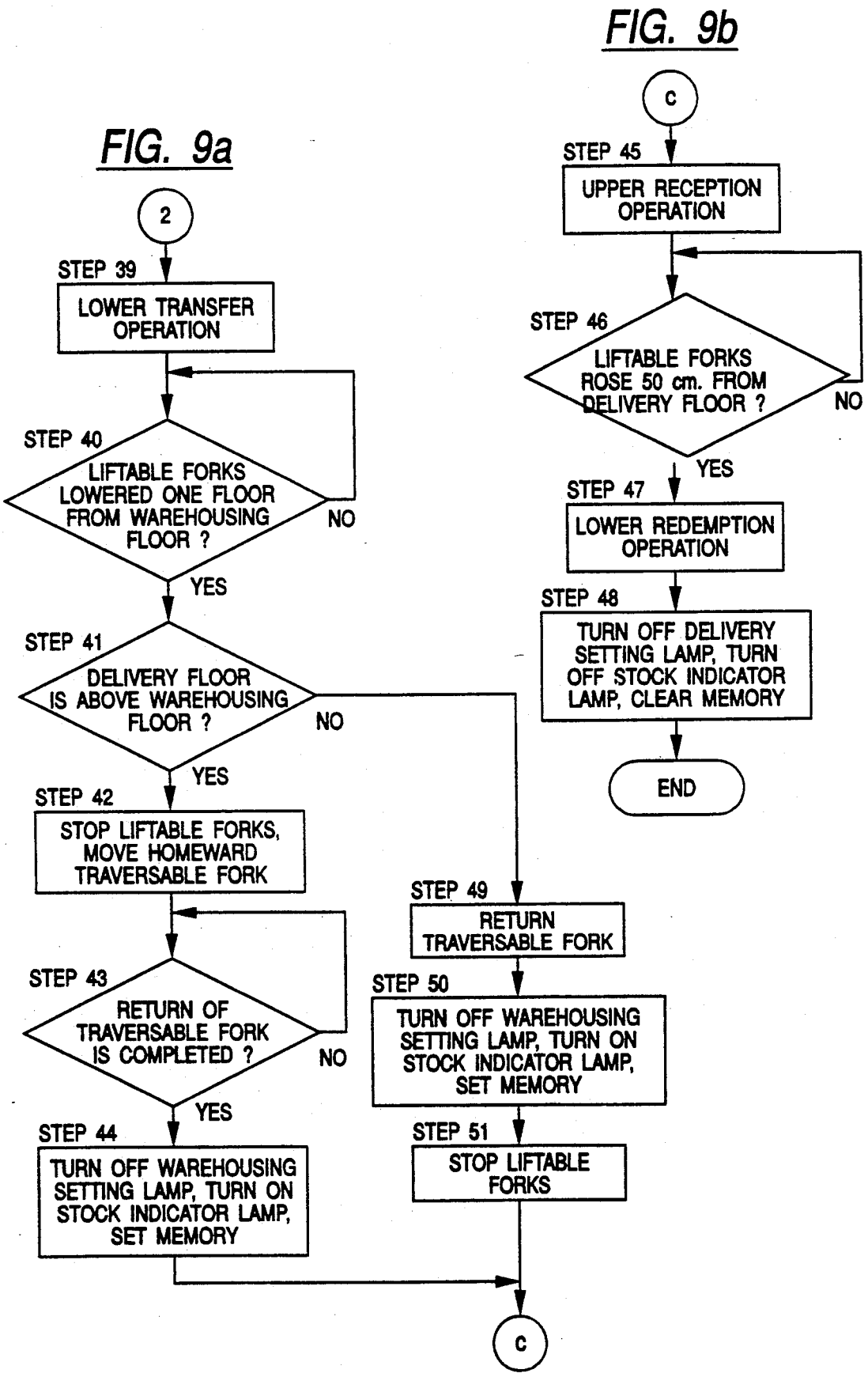
FIG. 9a
2
STEP 39
LOWER TRANSFER OPERATION
STEP 40
LIFTABLE FORKS LOWERED ONE FLOOR FROM WAREHOUSING FLOOR ?
NO
YES
STEP 41
DELIVERY FLOOR IS ABOVE WAREHOUSING FLOOR ?
NO
YES
STEP 42
STOP LIFTABLE FORKS, MOVE HOMEWARD TRAVERSABLE FORK
STEP 43
RETURN OF TRAVERSABLE FORK IS COMPLETED ?
NO
YES
STEP 44
TURN OFF WAREHOUSING SETTING LAMP, TURN ON STOCK INDICATOR LAMP, SET MEMORY
STEP 49
RETURN TRAVERSABLE FORK
STEP 50
TURN OFF WAREHOUSING SETTING LAMP, TURN ON STOCK INDICATOR LAMP, SET MEMORY
STEP 51
STOP LIFTABLE FORKS
C
FIG. 9b
C
STEP 45
UPPER RECEPTION OPERATION
STEP 46
LIFTABLE FORKS ROSE 50 cm. FROM DELIVERY FLOOR ?
NO
YES
STEP 47
LOWER REDEMPTION OPERATION
STEP 48
TURN OFF DELIVERY SETTING LAMP, TURN OFF STOCK INDICATOR LAMP, CLEAR MEMORY
END

METHOD FOR CONTROLLING A VEHICLE PARKING STRUCTURE

This is a divisional of copending application Ser. No. 07/056,598, filed on May 29, 1990, now U.S. Pat. No. 4,950,117, issued Aug. 21, 1990.

FIELD OF THE INVENTION

This invention relates to a three dimensional housing apparatus and a control method thereof capable of performing speedily and safely the warehousing process and delivery process of an object to be housed with a simple external control.

DESCRIPTION OF THE PRIOR ART

The three dimensional housing apparatus is hitherto known as disclosed in, for example, Japanese Utility Model Publication No. 54-62286. According to this publication, as shown in FIG. 50, a liftable fork 101 equipped with fork pieces 101*a* is hung down by wires 102 in the space of a central section, and a traversable housing fork 104 equipped with fork pieces 104*a* is mounted on traverse rails 103 disposed in each floor housing space provided on either side of the central space. When to house, for example, a car on the traversable housing fork 104, the liftable fork 101 with a car mounted thereon is suspended in a loading position or station provided in the section of the first floor at a height a little higher than a designated traversable housing fork 104. Then, this traversable housing fork 104 is traversed so as to come under the fork pieces 101*a* of the liftable fork 101, and the liftable fork 101 is gradually lowered such that the fork pieces 101*a* and 104*a* come to mesh with each other, whereby the car is transferred to and mounted on the traversable housing fork 104. The liftable fork 101 having transferred the car is lowered down the the loading position, whereas the traversable housing fork 104 is returned to the initial position, whereby the parking process is completed.

Specifically, in the foregoing type of three dimensional housing apparatus, when to warehouse the object into a position or space which is, for example, above the loading position (an upper warehousing mode), after confirming that a designated traversable housing fork 104 has no object thereon, a switch is operated which commands the system to warehouse the object onto that traversable housing fork 104. On the contrary, when to deliver the object from a designated traversable housing fork 104, after confirming that the object exists on that traversable housing fork 104, a delivery command is given to the aforementioned liftable fork 101 to perform the delivery process.

Also, when to warehouse the object at a position above the loading position, after moving the liftable fork 101 up to a given position, a designated traversable housing fork 104 is traversed up to the center position of a lift space, and upon completion of the traversal movement of that traversable fork, the liftable fork 101 is started to move down. Then, as the liftable fork 101 returns to the loading position, that traversable housing fork 104 is returned into the corresponding housing space.

When to deliver the object from a position below the loading position (a lower delivery mode), after moving the liftable fork 101 down to a given position, a designated traversable housing fork 104 is traversed up to the center position, and upon completion of the traversal movement of that traversable fork, the liftable fork 101 is started to move up. Then, as the liftable fork 101 returns to the loading position, that traversable housing fork 104 is returned into the corresponding housing space.

In addition, at the time of delivery from a higher position (an upper delivery mode), the liftable fork 101 is started to move up after arrival of one traversable housing fork 104 at the center position, whereas at the time of warehousing to a lower position (a lower warehousing mode), the liftable fork 101 is started to move down after arrival of one traversable housing fork 104 at the center position.

Accordingly, it is necessary for the transfer of the car that after the liftable fork 101 with the object mounted thereon is accurately suspended at a position a little higher than a designated traversable housing fork 104, that traversable housing fork 104 be traversed so as to come immediately below the liftable fork 101, and the fork pieces 101*a* and 104*a* be made to mesh accurately with each other. Therefore, the foregoing conventional apparatus is inconvenient and the process of meshing is troublesome because it is influenced by the height of the liftable fork 101, the expansion of the wires 102, the deflection of the fork pieces 101*a* and 104*a*, and the like.

Further, since the respective fork pieces 104*a* of each traversable housing fork 104 are inserted on one side in between the fork pieces 101*a* of the liftable fork 101, one side of the traversable housing fork must be kept open. Thus, the traversable housing fork 104 must be supported only on the side opposite to the side where the fork pieces 104*a* are open, thereby resulting in a configuration of the cantilever type. Hence, in order to maintain level the posture of the object being housed in the mounted state, the structure of each traversable housing fork must be made strong, thereby resulting in the problem of increasing the manufacturing cost.

In addition, the conventional three dimensional housing apparatus must be operated, after confirming each time of operation as to whether or not an object exists on the traversable housing fork 104 held in a designated housing space, by selecting a warehousing operation command switch or a delivery operation command switch corresponding to a warehousing operation command or a delivery operation command directed to the liftable fork 101.

In addition, both in the upper warehousing mode and in the lower delivery mode, the return movement of the traversable housing fork 104 is started only after the liftable fork 101 has returned to the loading position, whereas both in the upper delivery mode and in the lower warehousing mode, the upward/downward movement of the liftable fork 101 is started only after the traversable housing fork 104 has reached the center position of the lift space.

Accordingly, the conventional apparatus had the problem that a long time is necessary for the warehousing process and for the delivery process.

SUMMARY OF THE INVENTION

The present invention has been devised to solve the foregoing problems, hence, it is an object of the present invention to provide a three dimensional housing apparatus which is simplified in the structure of a liftable fork and of each traversable housing fork, easy to manufacture, and low in manufacturing cost.

It is another object of the present invention to provide a three dimensional housing apparatus and a control method thereof wherein warehousing setting and delivery setting can simply and safely be achieved to effect the warehousing/delivery process of an object to be housed.

It is still another object of the present invention to provide a three dimensional housing apparatus and a control method thereof which make it possible to transfer and house an object to be housed speedily and safely.

It is a further object of the present invention to provide a three dimensional housing apparatus and a control method thereof which make it possible to utilize a site effectively and to achieve smoothly the warehousing process and delivery process of an object to be housed.

According to the present invention, a liftable fork unit movable up and down in a lift space (E) is composed of a pair of liftable forks (5*a*,5*b*), and the transfer of an object (C) to be housed is freely achieved by the up/down movement of the liftable fork unit (5*a*,5*b*) and the traversal movement of a traversable housing fork (20) disposed in each housing space (X,Y) provided adjacent to the lift space (E). That is, the warehousing-/delivery process of the object (C) can speedily and safely be performed by the liftable fork unit (5*a*,5*b*) and each traversable housing fork (20) of simple structure.

The present invention uses a width sensor (77) for detecting a sidewise projection (79) of the object (C), which is provided on at least one side in the upper section of a loading position (E1). Thus, it is possible easily to confirm whether the liftable fork unit (5*a*,5*b*) with the object (C) mounted thereon can safely move up in terms of all possible height/position of the object (C), hence, the system is safe.

The present invention uses a confirming unit (23,29) for confirming the presence/absence of the object (C) in each housing space (X,Y) and an operation command switch (34,37) corresponding to each housing space (X,Y). Each operation command switch (34,37) functions as a delivery command switch if an object (C) exists in a corresponding housing space (X,Y) and as a warehousing command switch if no object exists.

Accordingly, it is not necessary for an operator to select between the warehousing setting and the delivery setting each time, hence, the warehousing/delivery setting can easily be effected.

The present invention causes the concurrent operation of the liftable fork unit (5*a*,5*b*) and the traversable fork (20) inn performing the warehousing/delivery process of the object (C) if permitted. Further, when the traversable housing fork (20) which has to reach a given position earlier than the liftable fork unit (5*a*,5*b*) does not reach earlier, the liftable fork unit (5*a*,5*b*) is stopped at a position immediately before the traversable housing fork (20) until the traversable housing fork (20) reaches the given position.

Accordingly, the warehousing/delivery process of the object (C) can speedily be achieved, and the liftable fork unit (5*a*,5*b*) can be stopped when the traversable housing fork (20) becomes out of order, hence, the system is very safe.

Further, the present invention makes it possible to effect the successive delivery of objects (C) from the housing spaces (X,Y) after the liftable fork unit (5*a*,5*b*) has completed the warehousing process with respect to a designated housing space (X,Y) and before the return of the liftable fork unit again to the loading position (E1), hence, the warehousing/delivery process can easily and speedily be achieved.

BRIEF DESCRIPTION OF THE DRAWINGS

FIGS. 7*a* through 19 are flowcharts illustrative of the operation of a drive and control processing circuit, in which FIGS. 7*a* and 7*b* are flowcharts showing the underground and overground delivery operation;

FIGS. 8*a* and 8*b* are flowcharts showing the underground and overground warehousing operation;

FIGS. 9*a* and 9*b* are flowcharts showing the underground concurrent warehousing/delivery operation;

FIG. 11 is a flowchart showing the upper reception operation;

FIG. 12 is a flowchart showing the upper redemption operation;

FIG. 13 is a flowchart showing the upper reception operation;

FIG. 14 is a flowchart showing the lower reception operation;

FIG. 15 is a flowchart showing the lower redemption operation;

FIG. 16 is a flowchart showing the upper transfer operation;

FIG. 17 is a flowchart showing the lower return operation;

FIG. 18 is a flowchart showing the lower transfer operation; and

FIG. 19 is a flowchart showing the upper return operation;

DESCRIPTION OF THE PREFERRED EMBODIMENTS

A first embodiment of a three dimensional housing apparatus for cars which embodies the present invention will first be described with reference to FIGS. 1 through 23.

Figure 1:
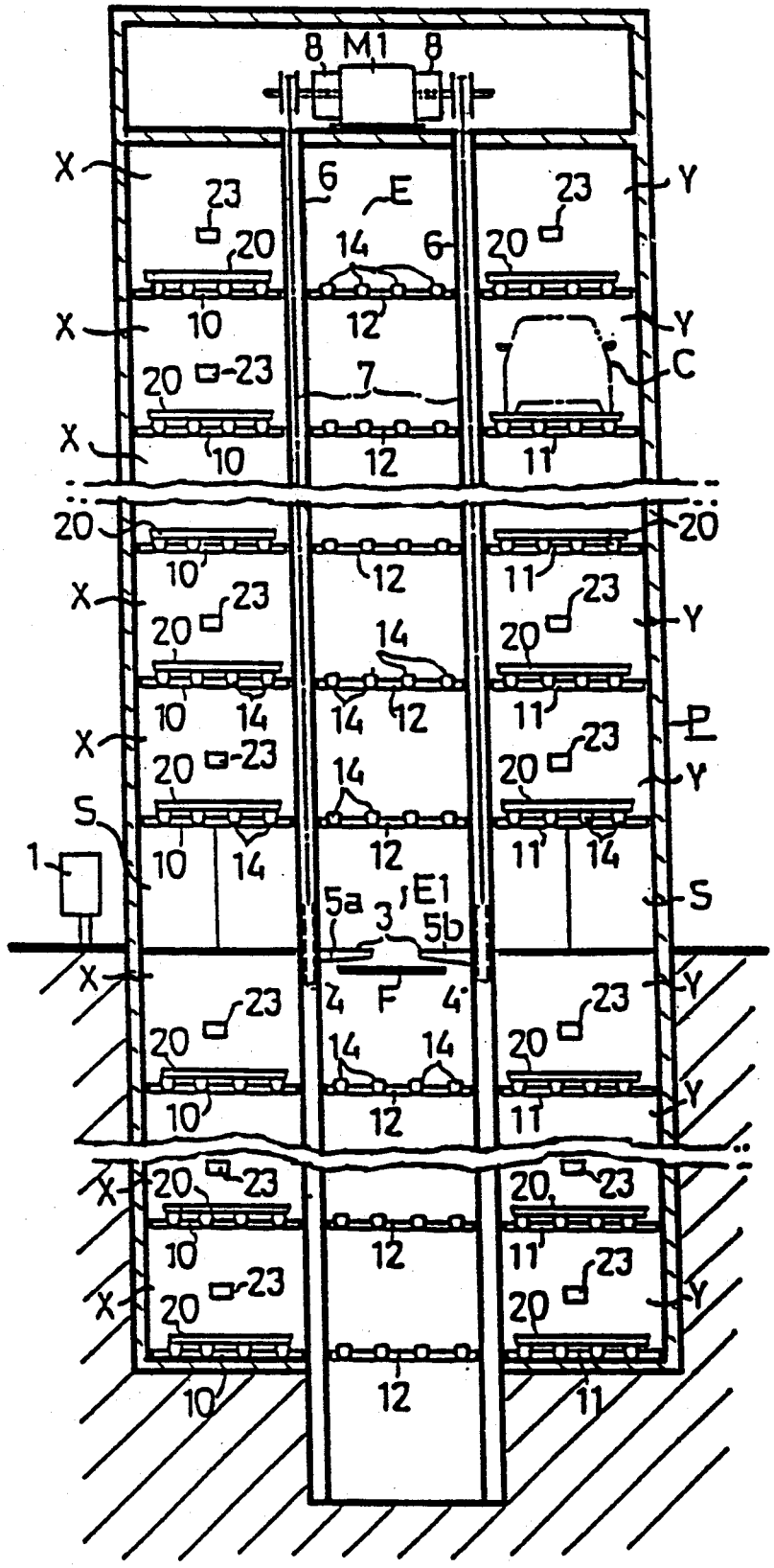
FIG. 1 is a vertical sectional view of a first embodiment of a three dimensional housing tower of a three dimensional housing apparatus for cars which embodies the present invention.

In the drawings, a console panel 1 is provided for processing the drive and control of the three dimensional housing apparatus for cars, which includes a drive and control processing circuit A of the three dimensional housing apparatus for cars and, as shown in FIG. 1, is disposed at a position close to a three dimensional housing tower P for cars.

FIRST EMBODIMENT

Figure 4:
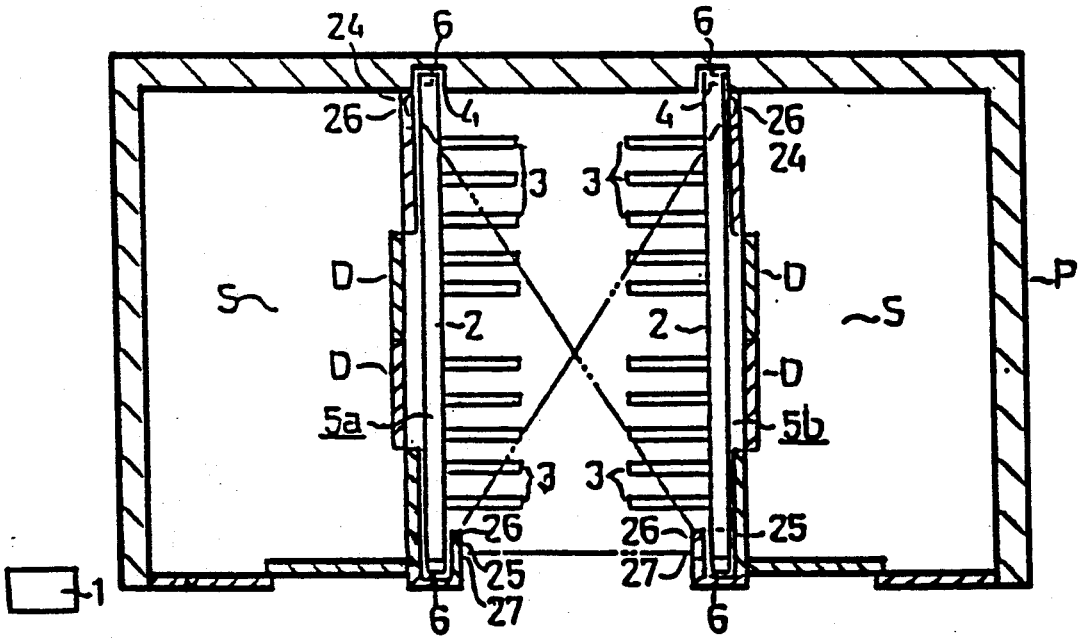
FIG. 4 is a transverse sectional view showing the first floor section of the three dimensional housing tower.
Figure 6:
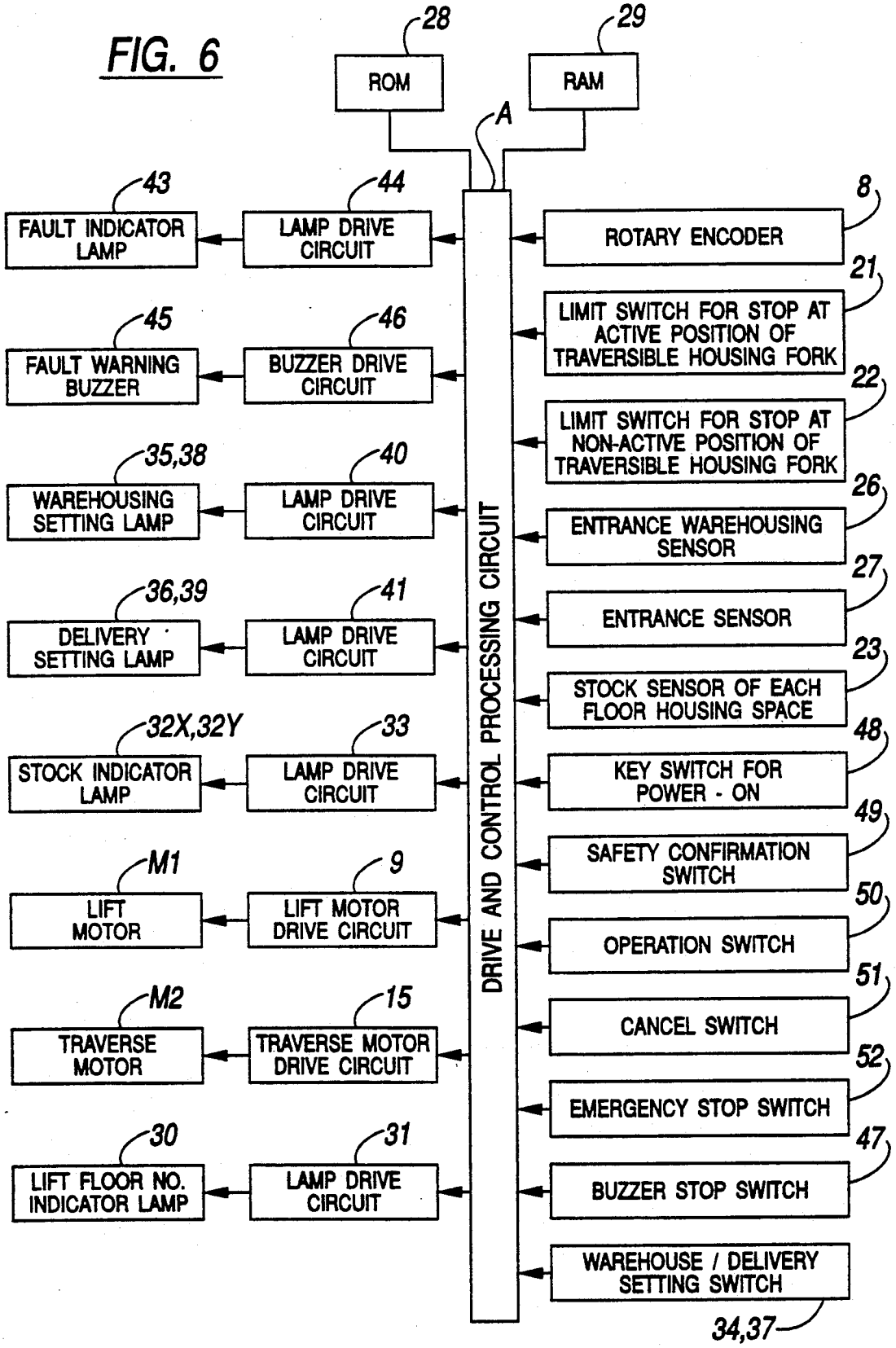
FIG. 6 is an electric block circuit diagram of the three dimensional housing apparatus.
Figure 7A:
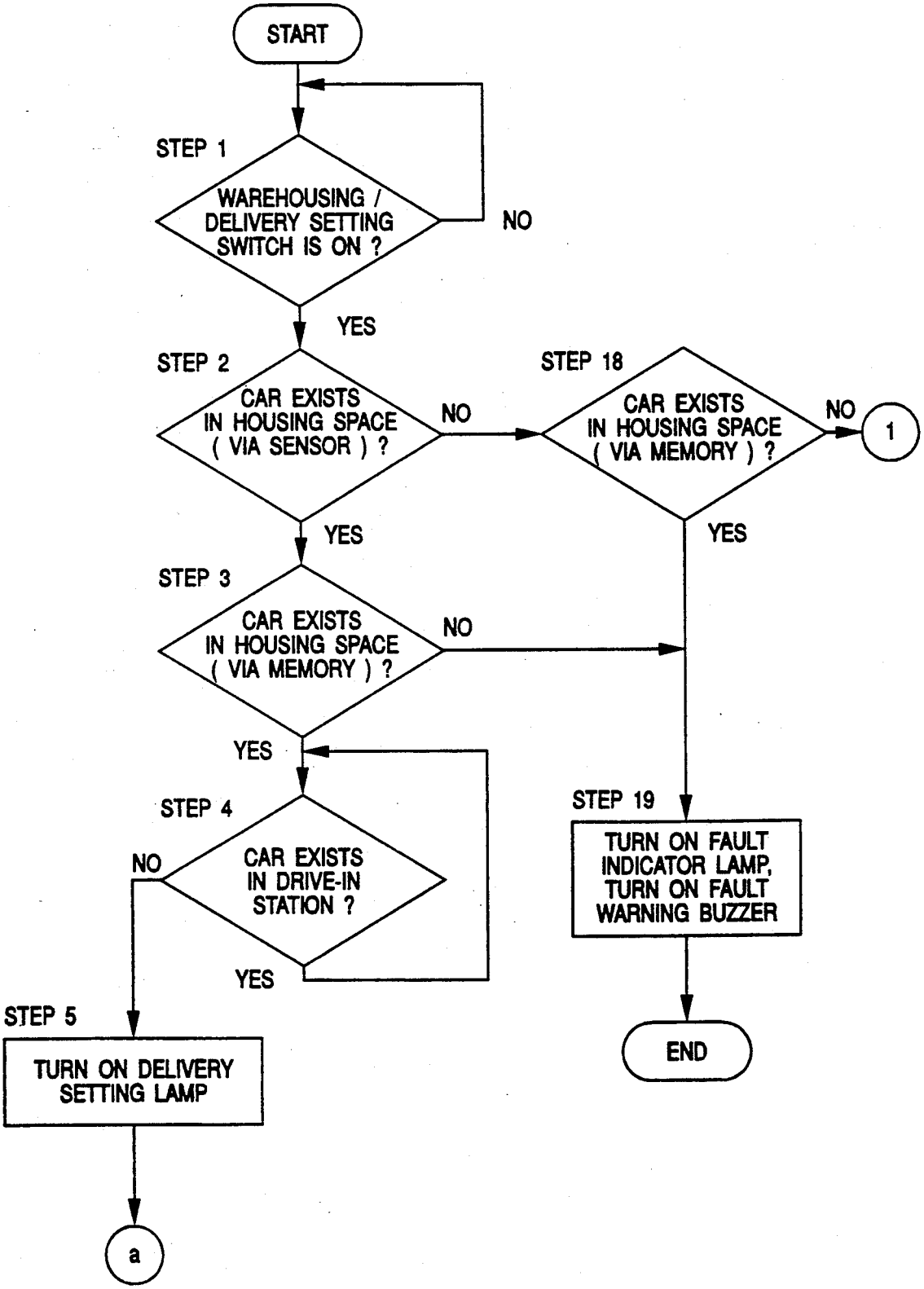
Figure 7B:
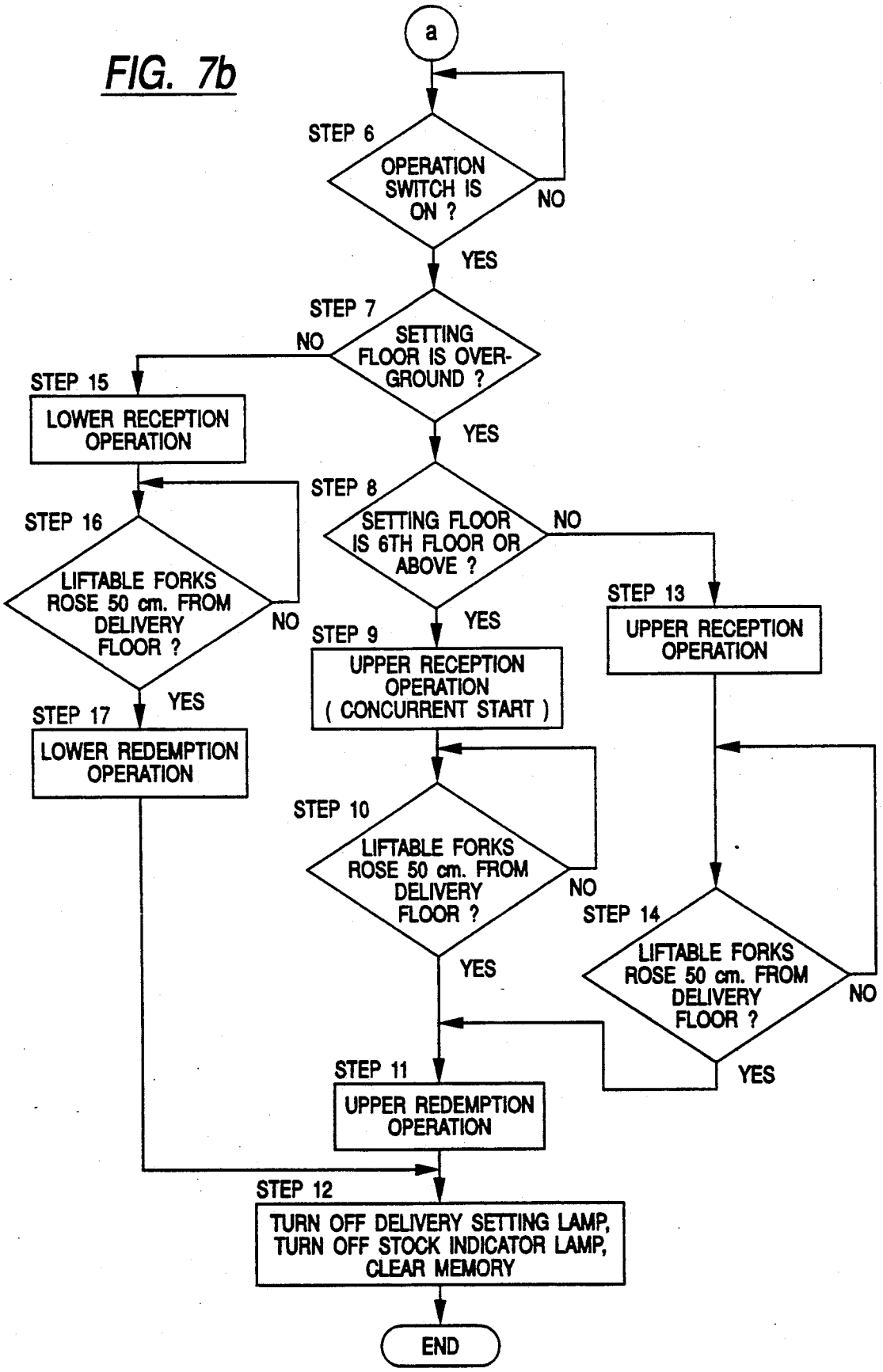

In this first embodiment, the three dimensional housing tower P composed of twelve overground floors and five underground floors has a lift space E provided in its central section for allowing an object to be housed, e.g. a car C, to move up and down thereinside, and housing spaces X and Y provided on either side of the lift space E in a respective floor for housing therein the car C. A portion of the lift space E corresponding to the first floor is a drive-in station E1 serving as a loading position of the car C. As shown in FIG. 4, both side sections of the drive-in station E1 are anterooms S which are equipped with distribution panels and the like. The drive-in station E1 permits anyone to get access thereto through automatic on-off doors D. These automatic doors D may be of the single swing type depending upon the circumstances of the drive-in station E1.

The automatic doors D are designed such that as an entrance warehousing sensor (hereinafter described) 26 detects the condition that the car C exists in the drive-in station E1, the open, whereas as a driver and passengers get off and a warehousing-delivery setting switch (hereinafter described), 34,37, is operated, they close. Further, as the car C is returned from the housing space, X,Y, to the drive-in station E1, the automatic doors D open. Then, as the car C is driven by the driver and a signal from the entrance warehousing sensor 26 discontinues, they close again. A fall prevention plate F provided in a portion of the lift space E corresponding to the first overground floor, shown in FIG. 1, is a means for preventing occurrence of accidental downfall of workers and the like below ground, and is designed such that it can retract backward so as not to disturb the movement of both liftable forks (hereinafter described) 5*a* and $5_b$ at the time of underground delivery/underground warehousing.

The fall prevention plate F may be implemented such that it traverses and retracts toward a ceiling portion of the left/right-side housing space, X,Y, of the first underground floor so as not to disturb the movement of both liftable forks 5*a* and 5*b*. Further, in place of providing the fall prevention plate F, for the purpose of preventing occurrence of accidental downfall of workers and the like below ground, both liftable forks 5*a* and 5*b* may be designed such that the spacing between the distal ends of fork pieces 3 of these liftable forks is short and the number of fork pieces is large.

In foregoing arrangement, it is also possible to set up a safety fence (not shown) in an entrance portion of the drive-in station E1, which is automatically closed to surely prevent occurrence of dangerous downfall of workers and the like before both liftable forks 5*a* and 5*b* start to move up or down.

Figure 3:
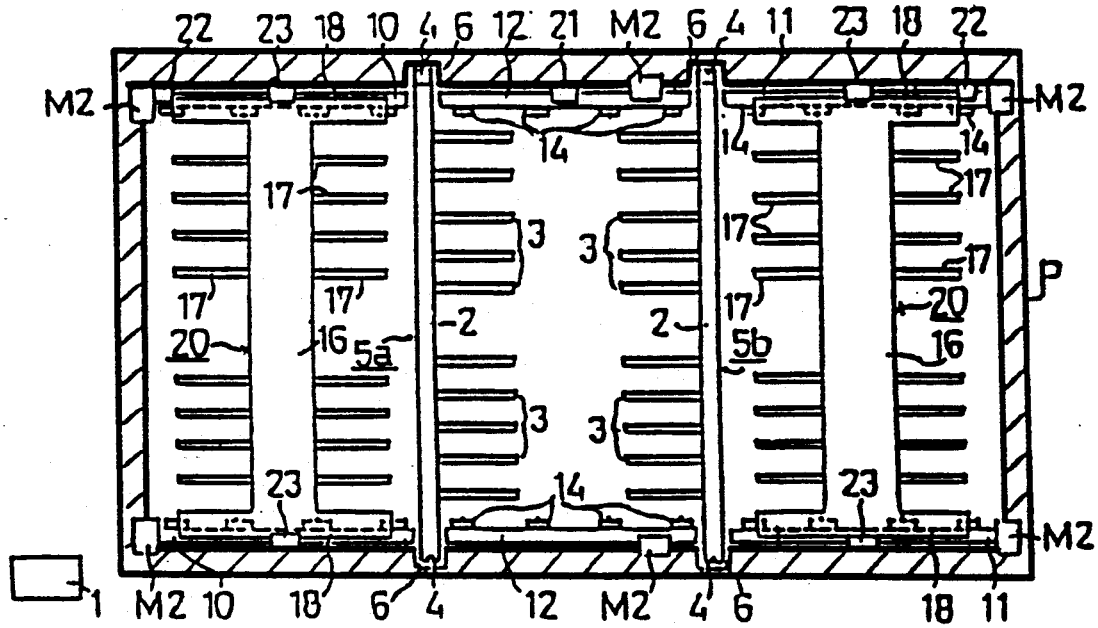
FIG. 3 is a transverse sectional view of the three dimensional housing tower.

As shown in FIGS. 3 and 4, a pair of left liftable fork 5*a* and right liftable fork 5*b* constitutes a lift unit which comprises two quadrangular prism-like fixing members 2, a plurality of fork pieces 3 projecting inward from the fixing members at given intervals, and four support members 4 provided at both front and rear ends of the fixing members and extending vertically. These left and right liftable forks 5*a* and 5*b* are liftable or movable up and down while the support members 4 are guided by lift guide rails 6 provided at four corners of the lift space E. These fork pieces 3 are dimensioned so as to leave a given spacing between the distal ends thereof.

The upper end of each support member 4 is coupled with the lower end of each chain 7 passing inside each lift guide rail 6. Thus, as the chains 7 are wound up by a lift motor M1 provided in an upper portion of the three dimensional housing tower P, both liftable forks 5*a* and 5*b* are driven and lifted. Specifically, both liftable forks 5*a* and 5*b* are parallelly driven and lifted at the same speed while always maintaining the same height, and their absolute position is continuously measured by a rotary encoder 8 provided on the output shaft of the lift motor M1.

The lift motor M1 is driven and controlled by a lift motor drive circuit 9 which in turn is controlled by the drive and control processing circuit A actuated on the basis of a program stored in a ROM (read-only memory) 28. As both liftable forks 5*a* and 5*b* move up 50 cm from the stopped state, the drive and control processing circuit A changes an operation mode from a low-speed operation mode wherein both liftable forks 5*a* and 5*b* are moved up at low speeds to a high-speed operation mode wherein both liftable forks 5*a* and 5*b* are moved up at high speeds.

Similarly to the above, as both liftable forks 5*a* and 5*b* move down 50 cm from the stopped state, the drive and control processing circuit A changes the operation mode from the low-speed operation mode wherein both liftable forks 5*a* and 5*b* are moved down at low speeds to the high-speed operation mode wherein both liftable forks 5*a* and 5*b* are moved at high speeds. In this embodiment, however, for the prupose of prevention of danger, the high-speed operation mode is not introduced if a traversable housing fork (hereinafter described) 20 already exists on standby within the lift space E at a position below both liftable forks 5*a* and 5*b*.

As shown in FIGS. 1 and 3, the housing spaces X and Y of each floor have traverse roller frames 10 and 11 of long quadrangular box shape serving as supporting means which are provided at both front and rear edges thereof. Similarly, the lift space E has center position traverse roller frames 12 serving as supporting means which are provided at both front and rear edges thereof in each floor. Each inner surface of the pair of traverse roller frames 10 has four pulleys 14 distributed at given intervals, the support shafts of these pulleys 14 are interlinked together by a chain (not shown) provided inside each traverse roller frame 10, and there pulleys can be driven and rotated via the chain by a traverse motor M2 serving as a driving means which is provided at one end of the traverse roller frame 10. The traverse roller frames 11 and 12 are similarly equipped with pulleys 14, chains, and traverse motors M2.

Similarly to the case of the lift motor M1, the traverse motors M2 are driven and controlled by a traverse motor drive circuit 15 which in turn is controlled by the drive and control processing circuit A.

A fork piece fixing member 16 stretched between the traverse roller frames 10 is made narrower than the spacing between the distal ends of the fork pieces 3 of both liftable forks 5*a* and 5*b*. A plurality of fork pieces 17 extending orthogonally from both sides of the fork piece fixing member 16 are distributed in spaced relation so as to be alternate with the aforementioneed fork pieces 3.

The fork piece fixing member 16, fork pieces 17, and support frames 18 provided orthogonally at both front and rear edges of the fork piece fixing member 16 constitute a traversable housing fork 20. These support frames 18 are mounted on the pulleys 14 of the corresponding traverse roller frames 10. Thus, as the traverse motors M2 are driven, the traversable housing fork 20 can reciprocatingly move from the housing space X to the lift space E and reversely from the lift space E to the housing space X.

Similarly, on the traverse roller frames 11 is mounted another traversable housing fork 20 of the same structure as above, which can reciprocatingly move from the housing space Y to the lift space E and reversely from the lift space E to the housing space Y. Accordingly, after both liftable forks 5*a* and 5*b* and the traversable housing fork 20 are aligned vertically within the lift space E, if they intersect in the vertical direction to pass each other, the car C can be transferred therebetween.

Specifically, as the traversable housing fork 20 reaches the center position of the lift space E, a limit switch 21 provided in the central section of the rear-edge center-position traverse roller frame 12 is actuated to stop the traversable housing fork 20. Also, as the traversable housing fork 20 returns from the lift space E to the center position of the housing space, X,Y, another limit switch 22 provided at one end of the rear-edge traverse roller frame, 10,11, is actuated to stop the traversable housing fork 20.

In case some doors of the car C mounted on the liftable forks 5*a* and 5*b* or on the traversable housing fork 20 are not closed completely, the doors tend to open due to vibrations arising during the lifting and/or traversing operation, as a result, there is a possibility that an accident of damaging the doors and/or facilities and the like will happen.

Figure 24:
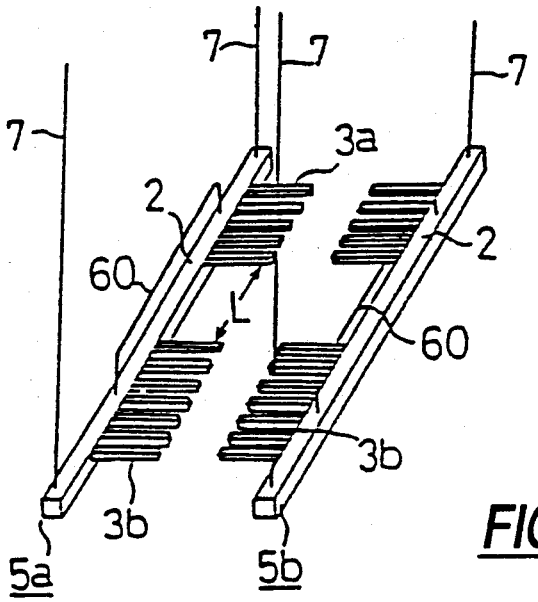
FIG. 24 is a perspective view showing the liftable forks each equipped with a first door-open preventing member.
Figure 25:
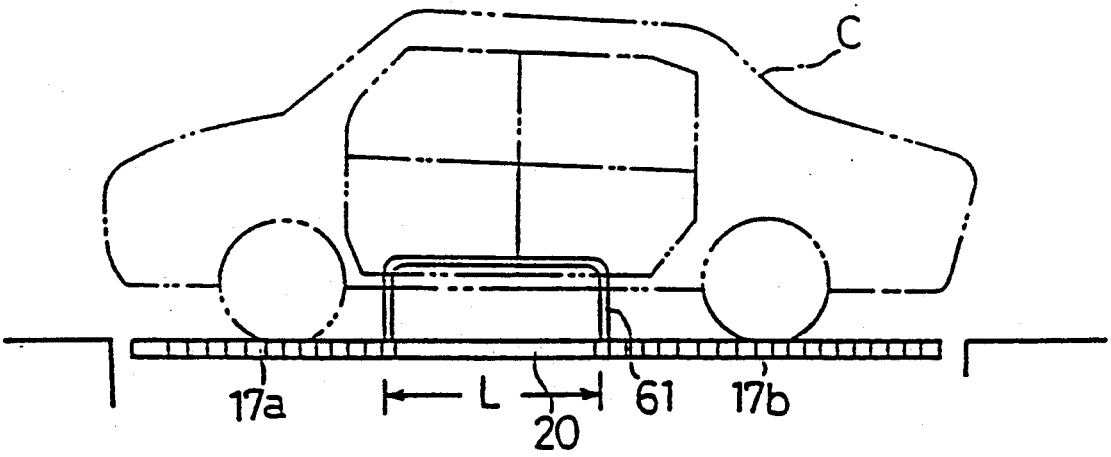
FIG. 25 is a side view showing the traversable housing fork with a car mounted thereon.

In this respect, as shown in FIG. 24, a gap L is provided between the fork pieces 3*a* on the front-wheel side and the fork pieces 3*b* on the rear-wheel side, and a first door-open preventing member 60 made, for example, of pipe or metal rod (which may be made of metallic plate, wooden board, or synthetic resin board) is provided in an upper central portion of each fixing member 2. Specifically, the height of this first door-open preventing member 60 is determined such that this member comes into contact with a lower portion of each door of the car C, as shown in FIG. 25.

Figure 26:
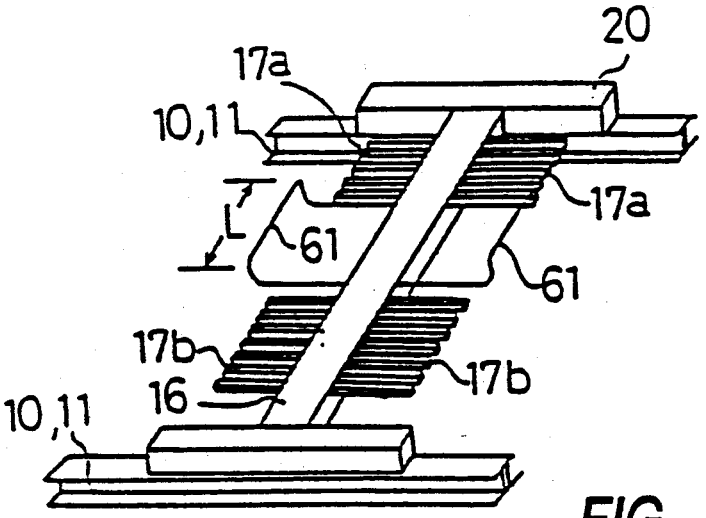
FIG. 26 is a perspective view showing the traversable housing fork equipped with second door-open preventing members.
Figure 27:
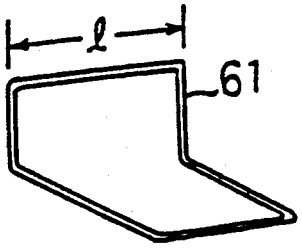
FIGS. 27 and 28 are perspective views showing the second door-open preventing members.

Further, as shown in FIG. 26, a gap l narrower than the gap L between the fork pieces 3*a* and the fork pieces 3*b* is provided between the fork pieces 17*a* on the front-wheel side and the fork pieces 17*b* on the rear-wheel side of the fork piece fixing member 16 of the traversable housing fork 20. The base end portion of a second door-open preventing member 61, made by pipe, metal rod, or the like into the form of a channel, is fixed to either side surface of the fork piece fixing member 16 in the gap l section. The free end portion of the second door-open preventing member is adjusted in height so as to come into contact with a lower portion of each door of the car C by appropriately bending the free end portion upward as shown in FIG. 27.

Figure 28:
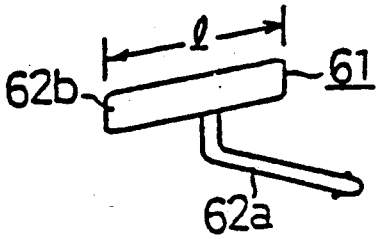

In place of the above structure, the second door-open preventing member 61 may be implemented, as shown in FIG. 28, such that the base end portion of an L-shaped support member 62*a* is fixed to either side surface of the fork piece fixing member 16 in the gap l section, and the central portion of a board-like door receiving member 62*b* is fixed to the free end of the support member 62*a* . Further, depending upon the circumstances of the parking-place, either the first door-open preventing member 60 or the second door-open preventing member 61 may be omitted in practicing the present invention.

Because of the thus configured first door-open preventing member 60 and second door-open preventing member 61 when both liftable forks 5*a* and 5*b* and the traversable housing fork 20 pass each other within the lift space E while vertically intersecting mutually, the second door-open preventing member 61, dimensioned so as to fall within the gap l, which is smaller than the gap L, defined between the fork pieces 17*a* on the front-wheel side and the fork pieces 17*b* on the rear-wheel side, can pass through the section of the gap L, thus, the transfer of the car C cannot be disturbed. Therefore, an accident that would happen if the door is open can always be prevented by means of the first door-open preventing member 60 and/or the second door-open preventing member 61 even while the car is transferred within the lift space E.

A stock sensor 23 serving as a confirmation unit is always detecting whether or not the car C is housed in each housing space, X,Y, which is composed of a pair of elements opposedly disposed at a lower position offset a little from the center on the front and rear end walls of each housing space, X,Y.

Further, light emitting elements 24 are provided on both sides in the rear section of the drive-in station E1 and light receiving elements 25 are provided on the lift guide rails 6 on this side, diagonally facing opposite the light emitting elements, both at a height of about 60 cm from ground; these elements constituting an entrance warehousing sensor 26. This entrance warehousing sensor 26 detects whether or not the car C is mounted on both liftable forks 5*a* and 5*b* and sends a detection signal to the drive and control processing circuit A.

An entrance sensor 27 is provided between the lift guide rails 6 on this side of the drive-in station E1, which detects whether or not a person goes in/out of the drive-in station E1 and sends a detection signal to the drive and control processing circuit A. When the entrance sensor 27 detects the fact that a person or the car C went in/out of the drive-in station E1 during the ware-housing/delivery operation of both liftable forks 5*a* and 5*b* and the traversable housing fork 20, it causes the system to effect an emergency stop of the ware-housing/delivery operation.

Figure 30:
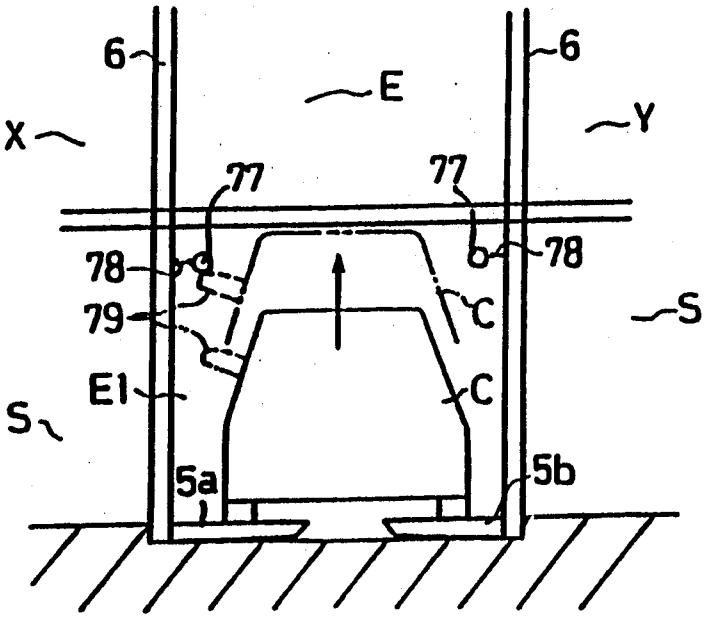
FIG. 30 is a front view of the drive-in station provided with the car-width sensor.
Figure 29:
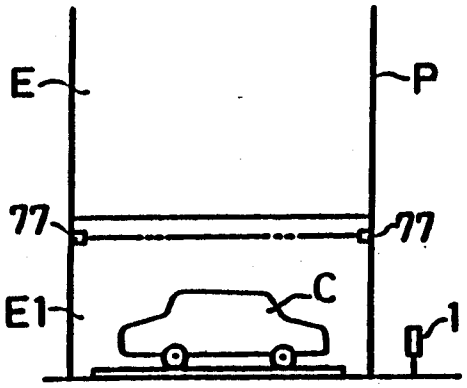
FIG. 29 is a side view of a drive-in station provided with a car-width sensor.

Further, as shown in FIGS. 29 and 30, two car-width sensors 77 are provided on either side in the upper section of the drive-in station E1 with each leaving a gap 78 such that the car C can safely move up and down while being spaced from both side walls of the drive-in station E1. That is, the car-width sensors 77 detects any substance if exists which is so close to either side wall of the drive-in station E1 as to fall within the gap 78 and sends a detection signal to the drive and control processing circuit A.

Accordingly, while both liftable forks 5*a* and 5*b* with the car C mounted thereon are moving up, if the car C has a projection 79 extending sidewise and if the car-width width sensor 77 senses this projection 79, this car-width sensor 77 sends a detection signal to the drive and control processing circuit A. In response thereto, the drive and control processing circuit A effects an emergency stop of the warehousing operation of both liftable forks 5*a* and 5*b*. Thereafter, if desired , both liftable forks 5*a* and 5*b* may be caused to return to the lower section of the drive-in station E1.

In the above arrangement, since the car-width sensors 77 are provided on either side in the upper section of the drive-in station E1 such that the elements of each sensor are separated from each other in front-rear direction, they can thoroughly detect all projections 79 extending sidewise from the car C at any height, hence, the system is very safe.

Figure 2:
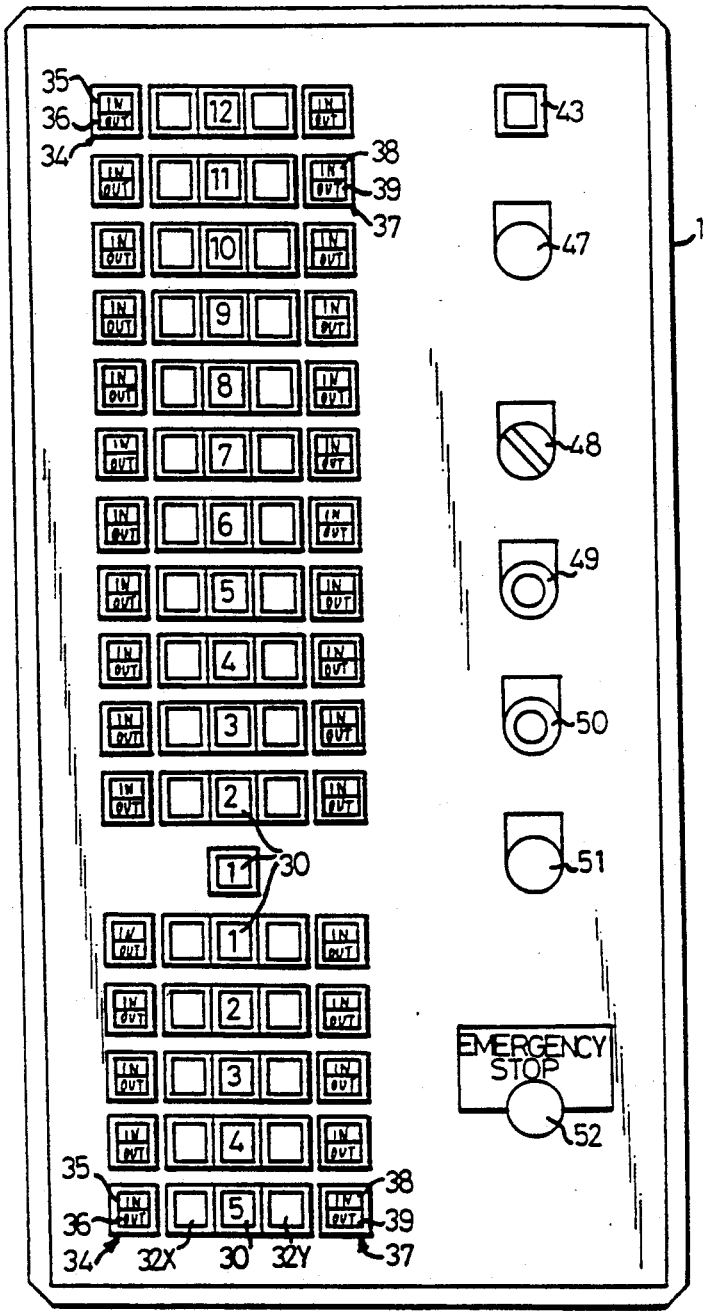
FIG. 2 is a front view of a console panel of the apparatus.
Figure 5:
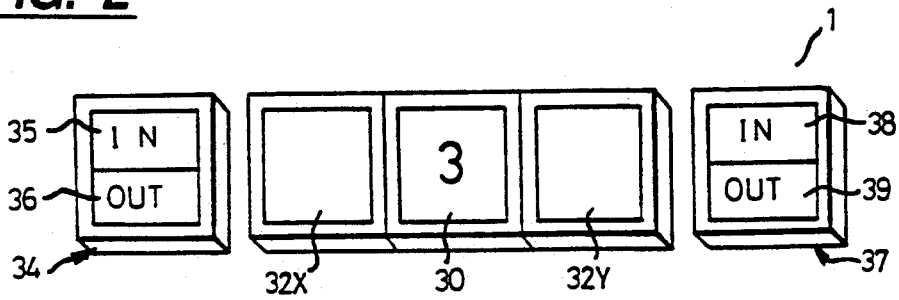
FIG. 5 is an enlarged front view of an important portion of the console panel.

In FIG. 2, lift floor number indicator lamps 30, arranged in one vertical row displaced a little to the left from the center of the console panel 1, are numbered consecutively from the top in the order of 12, 11, 10, 9, . . . , 3, 2, 1, 1, 2, 3, 4, and 5 correspondingly to the twelve overground floors and the five underground floors of the three dimensional housing tower P. The drive and control processing circuit A calculates the position of both liftable forks 5*a* and 5*b* on the basis of the measured data given from the rotary encoder 8 which indicates the position of both liftable forks 5*a* and 5*b* , and causes a lamp drive circuit 31 to turn on an indicator lamp 30 corresponding to the floor where both liftable forks 5*a* and 5*b* are positioned. On the left side of each indicator lamp 30 is provided a stock indicator lamp 32X corresponding to each housing space X which serves as an indicator unit for indicating the housing state of that housing space X, whereas on the right side is provided a stock indicator lamp 32Y corresponding to each housing space Y which serves as the indicator unit.

If judged on the basis of the detection signal of the stock sensor 23 provided inside each housing space X that the car C exists in that housing space X, the drive and control processing circuit A turns on the stock indicator lamp 32X corresponding to that housing space X via a lamp drive circuit 33. Similarly, if judged that the car C exists in the housing space Y, it turns on the stock indicator lamp 32Y in the same manner as above.

A warehousing/delivery setting switch 34 serving as an operation command switch provided on the left side of the stock indicator lamp 32X has a display section divided into two by a horizontal line. The upper half includes a warehousing setting lamp 35 labeled "IN", whereas the lower half includes a delivery setting lamp 36 labeled "OUT". Similarly to the above, on the right side of the stock indicator lamp 32Y is provided a warehouse/delivery setting switch 37 serving as an operation command switch. The upper half of the warehousing/delivery setting switch 37 includes a warehousing setting lamp 38 labeled "IN", whereas the lower half includes a delivery setting lamp 39 labeled "OUT".

If the drive and control processing circuit A judges, on the basis of the detection data given from the stock sensors 23 and the warehousing data stored in a RAM 29 made of a read/write-able memory which serves as a memory means for sequentially storing the warehousing/delivery operations of both liftable forks 5*a* and 5*b* and the traversable housing fork 20 and is connected with the drive and control processing circuit A, that no car C exists in a given housing space X, the warehousing/delivery setting switch 34 functions as a warehousing command switch.

In this case, the warehousing setting lamp 35 is turned on by the drive and control processing circuit A via a lamp drive circuit 40.

On the contrary, the warehousing/delivery setting switch 34 functions as a delivery command switch if the drive and control processing circuit A judges in a similar manner to the above that the car C exists in a given housing space X. Hence, the delivery setting lamp 36 is turned on by the drive and control processing circuit A via a lamp drive circuit 41.

Similarly to the case of the warehousing/delivery setting switch 34, if the drive and the control processing circuit A judges, on the basic of the detection data given from the stock sensors 23 and the warehousing data given from the RAM 29, that no car C exists in a given housing space Y, a warehousing/delivery setting switch 37 functions as a warehousing command switch, and a warehousing setting lamp 38 is turned on by the lamp drive circuit 40. On the contrary, if the drive and control processing circuit A judges that the car C exists in a given housing space Y, the warehousing/delivery setting switch 37 functions as a delivery command switch, and a delivery setting lamp 39 is turned on by the lamp drive circuit 41.

A fault indicator lamp 43 provided in a right-hand top portion of the console panel 1 is turned on by a lamp drive circuit 44 connected with the drive and control processing circuit A when some abnormal condition happens in the three dimensional housing apparatus. Of course, simultaneously with the turn-on of the fault indicator lamp 43, a fault warning buzzer 45 provided inside the console panel 1 is energized by a buzzer drive circuit 46 connected with the drive and control processing circuit A.

A buzzer stop switch 47 provided below the fault indicator lamp 43 is connected with the drive and control processing circuit A and is used when to stop the fault warning buzzer 45. A key switch 48 for power-on provided below the buzzer stop switch 47 is used when to power on/off the three dimensional housing apparatus.

A safety confirmation switch 49 provided below the key switch 48 is connected with the drive and control processing circuit A, and is used when to release the emergency stop of both liftable forks 5*a* and 5*b* and the traversable housing fork 20 that was caused when the entrance sensor 27 had detected a person and/or the car C going in and out. Thereafter, if an operation switch 50 provided below the safety confirmation switch 49 and connected with the drive and control processing circuit A is pushed, the warehousing/delivery operation of both liftable forks 5*a* and 5*b* and the traversable housing forks 20 is restarted.

This operation switch 50 is also effective, when pushed after the warehousing/delivery operation is instructed by the warehousing/delivery setting switch, 34,37, to start the warehousing/delivery operation of both liftable forks 5*a* and 5*b* and the traversable housing fork 20.

A cancel switch 51 provided below the operation switch 50 is used to cancel the warehousing/delivery setting operation instructed by the warehousing/delivery setting switch, 34,37, or when desired to reset a different warehousing/delivery operation. An emergency stop switch 52 provided below the cancel switch 51 is connected with the drive and control processing circuit A and is used when to effect an emergency stop of the warehousing/delivery operation of both liftable forks 5*a* and 5*b* and the traversable housing fork 20.

Incidentally, preparatory to the case of a failure and the necessity of adjustment of the three dimensional housing apparatus, the console panel 1 of this embodiment is equipped with a forced warehousing/delivery button (not shown), and manual warehousing setting switches and manual delivery setting switches (both not shown) corresponding to the respective housing spaces X and Y. As the forced warehousing/delivery button is switched on with the manual warehousing setting switch being ON, irrespective of one result of judgment based on the output of the entrance warehousing sensor 26 as to whether or not the car C exists in the drive-in station E1 and of another result of judgment based on the outputs of the stock sensors 23 and the warehousing data stored in the RAM 29 as to whether or not the car exists in the housing space, X,Y, the drive and control processing circuit A causes both liftable forks 5*a* and 5*b* and the traversable housing fork 20 to perform the warehousing operation.

Similarly, as the forced warehousing/delivery button is switched on with the manual delivery setting switch being ON, irrespective of one result of judgment based on the output of the entrance warehousing sensor 26 as to whether or not the car C exists in the drive-in station E1 and of another result of judgment based on the outputs of the stock sensors 23 and the warehousing data stored in the RAM 29 as to whether or not the car exists in the housing space, X,Y, the drive and control processing circuit A causes both liftable forks 5*a* and 5*b* and the traversable housing fork 20 to perform the delivery operation.

The action of the thus configured three dimensional housing apparatus for cars will now be described with reference to the flowcharts of FIGS. 7*a* through 19 illustrative of the operation of the drive and control processing circuit A.

When to deliver the car C housed in the housing space Y of the eleventh overground floor, as depicted by the imaginary line in FIG. 1, onto the ground, the worker pushes the warehousing/delivery setting switch 37 corresponding to that housing space Y. Then, at step 1 of judging whether or not the warehousing/delivery setting switch 37 is ON, the drive and control processing circuit A judges that the warehousing/delivery setting switch 37 is ON, Then, it executes the processing operation of step 2 of judging whether or not the car C exists in the housing space Y of the delivery setting floor on the basis of the output of the stock sensor 23.

If judged that the car C exists in the housing space Y, the drive and control processing circuit A executes the processing operation of step 3 of judging again whether or not the car C exists in the housing space Y on the basis of the warehousing data stored in the RAM 29.

Then, the drive and control processing circuit A executes the processing operation of step 4 of judging whether or not the car C exists in the drive-in station E1 on the basis of the output of the entrance warehousing sensor 26, and after confirming that no car C exists in the drive-in station E1, executes the processing operation of step 5 of turning on the delivery setting lamp 39. Then, after executing the processing operation of step 6 of judging whether or not the worker has switched on the operation switch 50 and if judged that the operation switch 50 has been switched on, the drive and control processing circuit A executes the processing operation of step 7 of judging whether or not the delivery setting floor is overground and further executes the processing operation of step 8 of judging whether or not the delivery setting floor is the sixth floor or above.

Because the delivery setting floor is the eleventh overground floor in this exemplary case, the control goes to the upper reception operation indicated in step 9.

Figure 11:
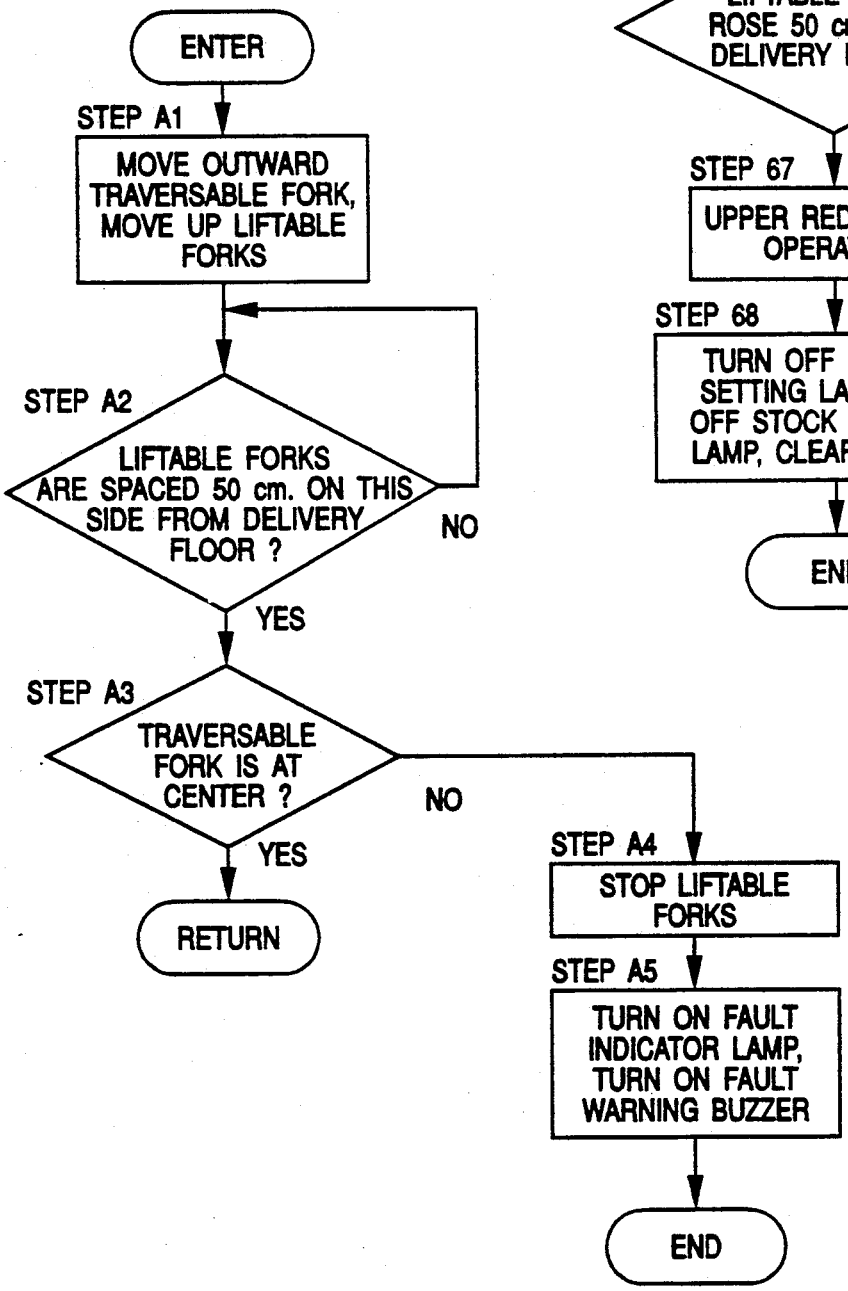

The upper reception operation of step 9 is shown in FIG. 11 wherein, as illustrated in FIG. 20*a*, the drive and control processing circuit A executes the processing operation of step A1 of concurrently starting the outward movement of the traversable housing fork 20 toward the center and the upward movement of both liftable forks 5*a* and 5*b*. Incidentally, the drive and control processing circuit A is designed such that it changes the operation mode from the low-speed operation mode to the high-speed operation mode after both liftable forks 5*a* and 5*b* move up 50 cm. Thereafter, the drive and control processing circuit A executes the processing operation of step A2 of judging whether or not both liftable forks 5a and 5b have reached the position spaced 50 cm on this side from the horizontal position of the traversable housing fork 20 of the delivery setting floor.

Then, the drive and control processing circuit A executes the processing operation of step A3 of judging whether or not the traversable housing fork 20 has reached the center. If the center has been reached, the operation mode of both liftable forks 5a and 5b is changed from the high-speed operation mode to the low-speed operation mode and their upward movement is continued. Then, the processing operation of step 10 is executed of judging whether or not both liftable forks 5a and 5b have reached the position 50 cm higher than the horizontal position of the traversable housing fork 20 of the delivery setting floor.

If in the processing operation of step A3 the traversable housing fork 20 has not yet reached the center position, this means that the traversable housing fork 20 is in trouble. Accordingly, the processing operation of step 4 is executed of stopping both liftable forks 5a and 5b, and after excuting the processing operation of step A5 of turning on the fault indicator lamp 43 and energizing the fault warning buzzer 45, the process is terminated.

If judged in step 10 that both liftable forks 5a and 5b have reached the position 50 cm higher than the horizontal position of the traversable housing fork 20, the drive and control processing circuit A goes to the upper redemption operation of step 11.

Figure 12:
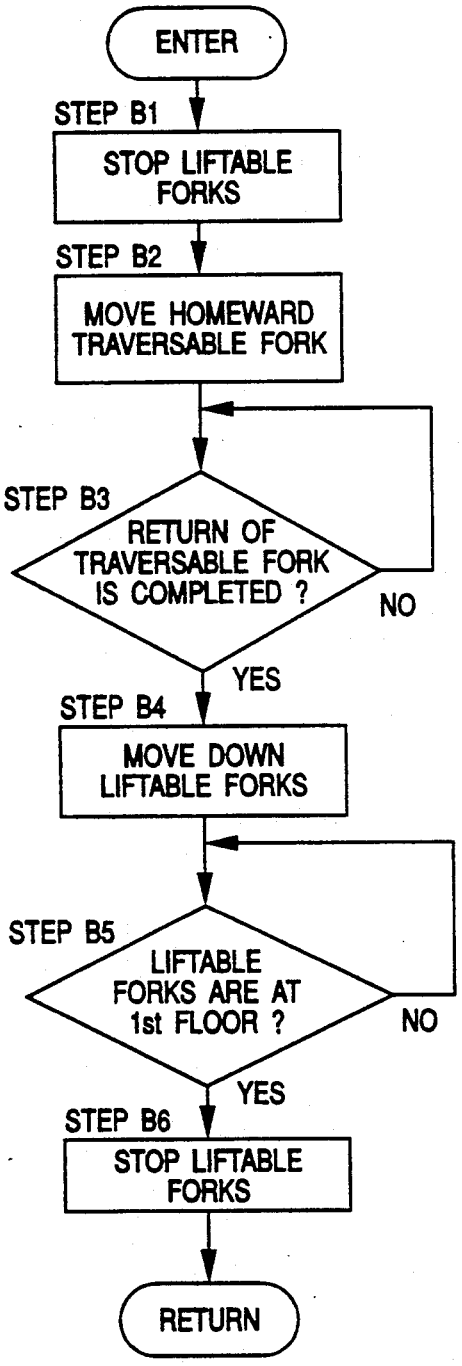

The upper redemption operation of step 11 is shown in FIG. 12. As illustrated in FIG. 20c, the drive and control processing circuit A first executes the processing operation of step B1 of stopping both liftable forks 5a and 5b. After executing the processing operation of step B2 of causing the homeward movement of the traversable housing fork 20, the drive and control processing circuit A executes the processing operation of step B3 of confirming the completion of return movement, or that the condition illustrated in FIG. 20d has been assumed. Then, the processing operation of step B4 is executed of changing both liftable forks 5a and 5b from the low-speed operation mode to the high-speed operation mode and continuing their downward movement.

Then, after executing the processing operation of step B5 of judging if both liftable forks 5a and 5b have assumed the condition illustrated in FIG. 20e, or if they have reached the position spaced 50 cm on this side from the first overground floor (the drive-in station E1), the drive and contol processing circuit A executes the processing operation of step B6 of changing both liftable forks 5a and 5b from the high-speed operation mode to the low-speed operation mode and stopping them.

As the processing operation of step 11 is completed, the drive and control processing circuit A executes the processing operation of step 12 of turning off the delivery setting lamp 36, turning off the stock indicator lamp 32Y; both held ON and corresponding to the housing space Y having executed the delivery process just now, and clearing the warehousing data stored in the RAM 29, whereby all delivery process of the car C from the housing space Y of the eleventh overground floor is completed. As will be apparent, the delivery process of the car C from the housing space X can be performed through the same processing operations as above.

The foregoing exemplary case of the delivery process has dealt with the delivery setting floor which is the sixth floor or above. In case the delivery setting floor is the fifth floor or below, the drive and control processing circuit A goes from the processing operation of step 8 to the upper reception operation of step 13.

Figure 13:
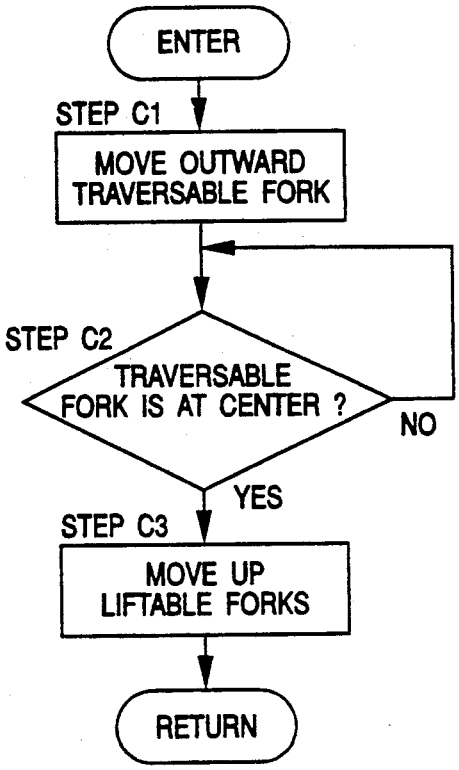

The upper reception operation of step 13 is shown in FIG. 13, which differs from the upper reception operation shown in FIG. 11. That is, after executing the processing operation of step C1 of causing the outward movement of the traversable housing fork 20 toward the center, the drive and control processing circuit A executes the processing operation of step C2 of confirming whether or not the traversable housing fork 20 has reached the center.

After confirming that the traversable housing fork 20 has reached the center, the drive and control processing circuit A executes the processing operation of step C3 of causing the upward movement of both liftable forks 5a and 5b and then executes the processing operation of step 14 of judging whether or not both liftable forks 5a and 5b have moved up 50 cm from the position of the delivery setting floor.

If confirmed in step 14 that both liftable forks 5a and 5b have moved up, the drive and control processing circuit A executes the processing operations of step 11 and so forth which were described in connection with the case where the delivary setting floor is the eleventh floor, whereby the process is completed. The foregoing two kinds of delivery processes are all pertinent to the delivery setting floor being overground. In the case of the delivary setting floor being underground, the drive and control processing circuit A goes from the processing operation of step 7 to the lower reception operation of step 15.

Figure 14:
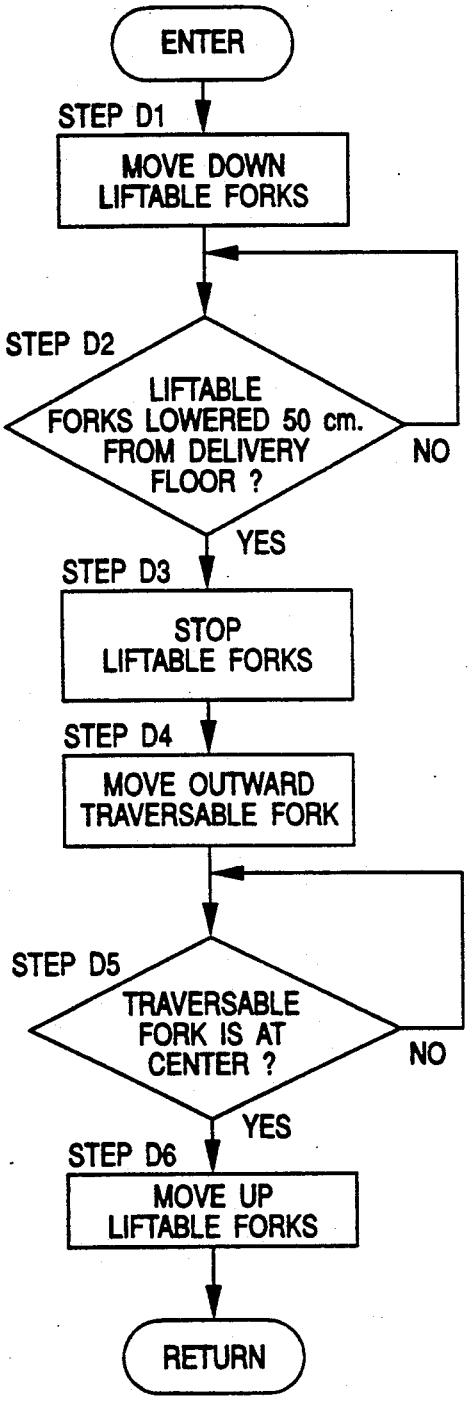

The lower reception operation of step 15 is shown in FIG. 14. That is, after executing the processing operation of step D1 of causing the downward movement of both liftable forks 5a and 5b as illustrated in FIG. 21a, the drive and control processing circuit A executes the processing operation of step D2 of judging whether or not both liftable forks 5a and 5b have moved down 50 cm from the horizontal position of the traversable housing fork 20 of the delivery setting floor. Then, after confirming in step D2 that both liftable forks 5a and 5b have moved down, the drive and control processing circuit A executes the processing operation of step D3 of stopping both liftable forks 5a and 5b and the processing operation of D4 of causing the outward movement of the traversable housing fork 20 toward the center as illustrated in FIG. 21b.

After executing the processing operation of step D5 of confirming whether or not the traversable housing fork 20 has reached the center and if confirmed that the traversable housing fork 20 has reached, the drive and control processing circuit A executes the processing operation of step D6 of causing the upward movement of both liftable forks 5a and 5b as illustrated in FIG. 21c.

Then, the drive and control processing circuit A executes the processing operation of step 16 of judging whether or not both liftable forks 5a and 5b have reached the position 50 cm higher than the position of the traversable housing fork 20 of the delivery setting floor, and after confirming their arrival, goes to the lower redemption operation of step 17.

Figure 15:
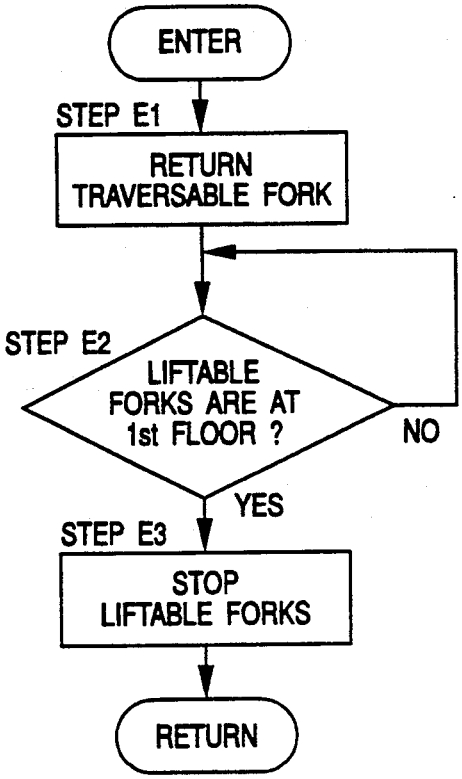

The lower redemption operation of step 17 is shown in FIG. 15. That is, the drive and control processing circuit A first executes the processing operation of step E1 of causing the return movement of the traversable housing fork 20 as illustrated in FIG. 21*d*. Then, the drive and control processing circuit A executes the processing operation of step E2 of judging whether or not both liftable forks 5*a* and 5*b* have reached the drive-in station E1 of the first overground floor, and after confirming their arrival, executes the processing operation of step E3 of stopping both liftable forks 5*a* and 5*b*.

Then, the drive and control processing circuit A executes the processing operation of step 12 of turning off the delivery setting lamp 36 and turning off the delivery indicator lamp, 32X,32Y, corresponding to the housing space, X,Y, having executed the delivery process, and clearing the warehousing data stored in the RAM 29, whereby the underground delivery process is completed.

Now, the warehousing process will be described. The drive and control processing circuit A confirms in step 1 the turn-on of the warehousing/delivery setting switch, 34,37, actuated by the worker, and executes the processing operation of step 2 of confirming on the basis of the output of the stock sensor 23 as to whether or not the car C exists in the housing space, X,Y. Then, if confirmed that no car C exists, the drive and control processing circuit A executes the processing operation of step 18 of confirming on the basis of the data of the RAM 29 as to whether or not the car C exists in the housing space, X,Y, just set.

In spite of the judgment done in step 2 that no car C exists in the housing space, X,Y, if the drive and control processing circuit A judges that the car C exists in the housing space, X,Y, this leads to the conclusion that either the stock sensor 23 or the RAM 29 is out of order. Therefore, the drive and control processing circuit A executes the processing operation of step 19 of turning on the fault indicator lamp 43 and energizing the fault warning buzzer 45, thereafter the process is terminated.

Of course, in step 3 of confirming with respect to the RAM 29 as to whether or not the car C exists in the housing space, X,Y, if the result of inquiry is in conflict with that of step 2, the drive and control processing circuit A executes the processing operation of step 19 described above, thereafter the process is terminated.

Figure 8A:
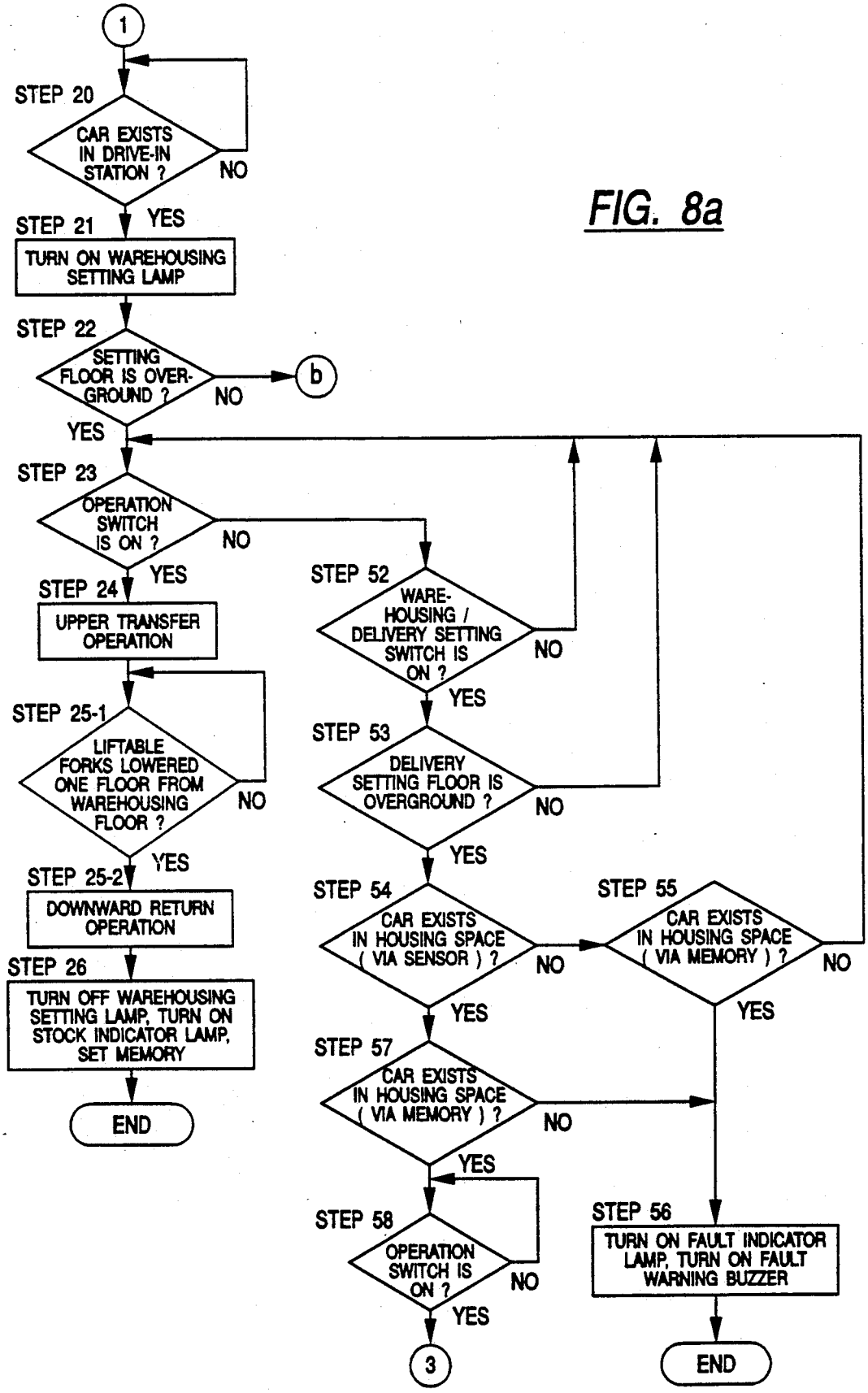
Figure 10A:
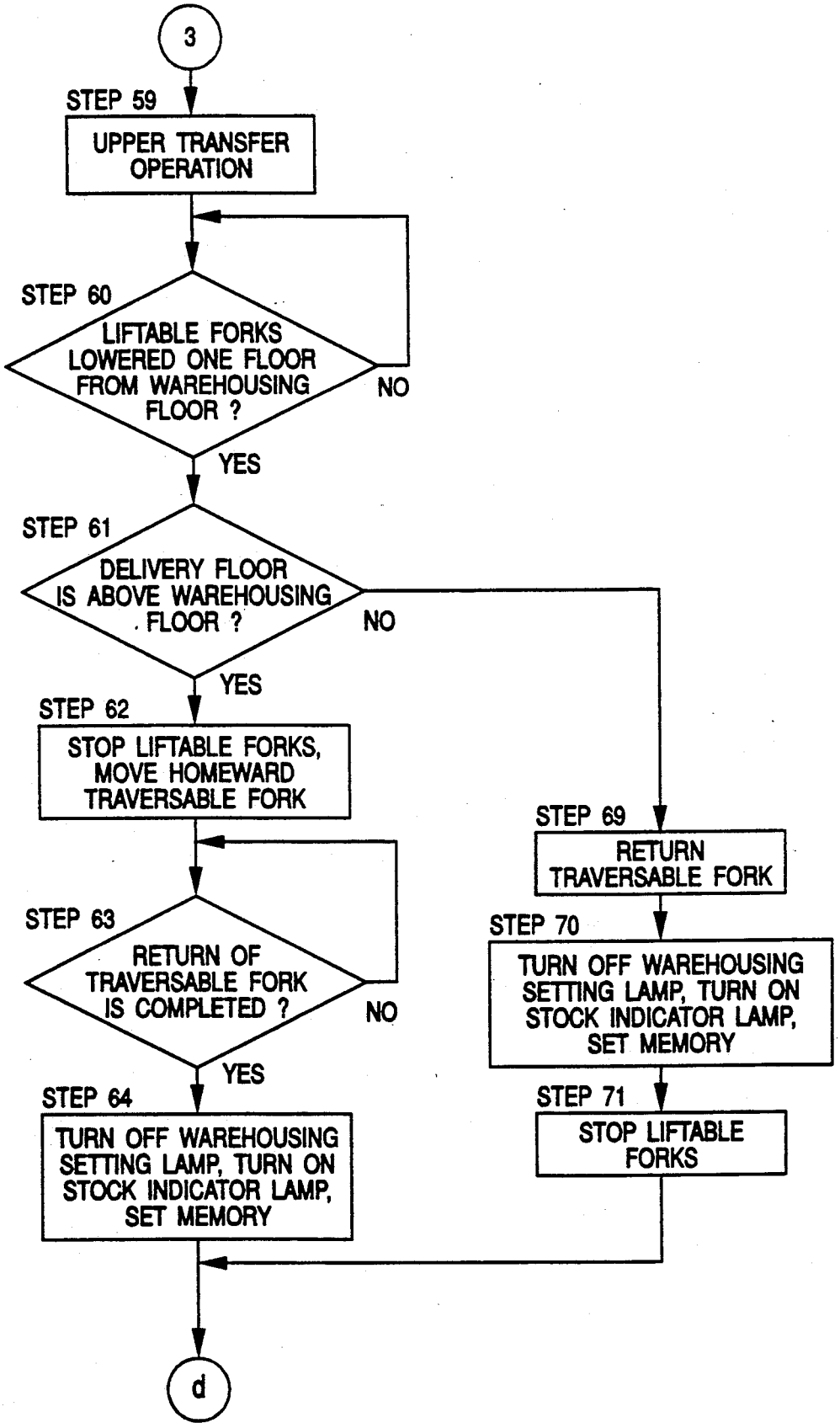
FIGS. 10*a* and 10*b* are flowcharts showing the overground concurrent warehousing/delivery operation.
Figure 10B:
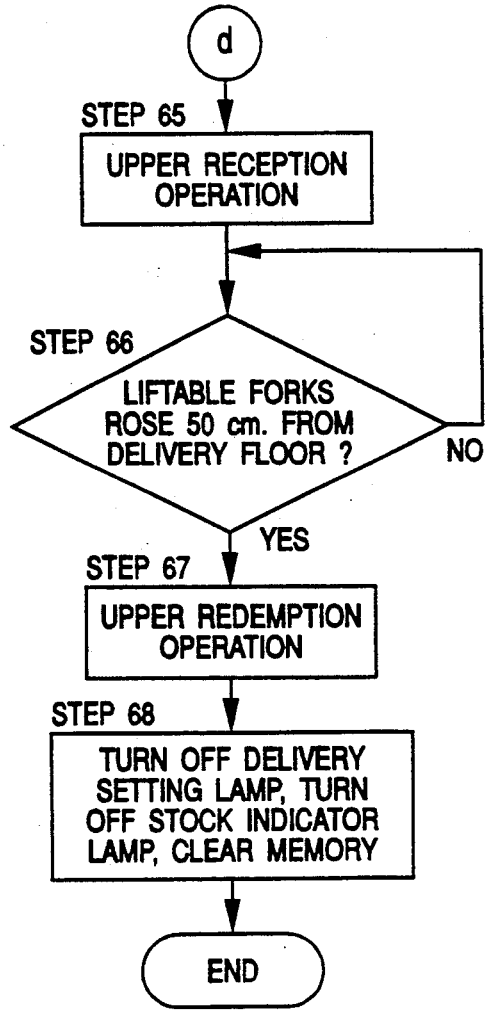

If confirmed in the processing operation of step 18 that no car C exists in the housing space, X,Y, the drive and control processing circuit A executes the processing operation of step 20 shown in FIG. 8. The drive and control processing circuit A judges in step 20 on the basis of the output of the entrance warehousing sensor 26 as to whether or not the car C exists in the drive-in station E1, and after confirming that the car C exists in the drive-in station E1, executes the processing operation of step 21 of turning on the warehousing setting lamp, 35,38.

Then, after executing the processing operation of step 22 of judging whether or not the warehousing setting floor is overground, if judged that the warehousing setting floor is overground and that the operation switch 50 has been switched on, the drive and control processing circuit A goes to the upper transfer operation of step 24.

Figure 16:
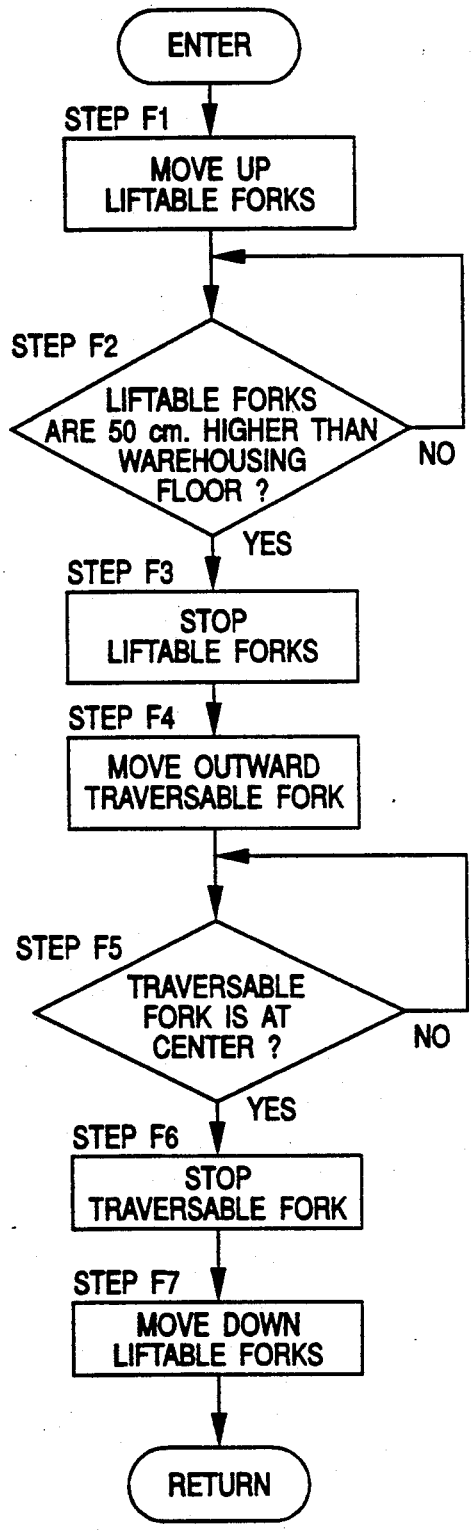

The upper transfer operation of step 24 is shown in FIG. 16. That is, the drive and control processing circuit A first executes the processing operation of step F1 of causing the upward movement of both liftable forks 5*a* and 5*b* as illustrated in FIG. 22*a*. Then, the drive and control processing circuit A executes the processing operation of step F2 of judging whether or not both liftable forks 5*a* and 5*b* have moved up 50 cm higher than the warehousing setting floor, and after confirming their upward movement, executes the processing operation of step F3 of stopping both liftable forks 5*a* and 5*b* and the processing operation of step F4 of causing the outward movement of the traversable housing fork 20 toward the center of the lift space E as illustrated in FIG. 22*b*.

The drive and control processing circuit A executes the processing operation of step F5 of confirming if the traversable housing fork 20 has reached the center and the processing operation of step F6 of stopping the traversable housing fork 20. Then, the drive and control processing circuit A executes the processing operation of step F7 of causing the downward movement of both liftable forks 5*a* and 5*b* as illustrated in FIG. 22*c*. Thereafter, the drive and control processing circuit A executes the processing operation of step 25-1 of judging whether or not both liftable forks 5*a* and 5*b* have moved down one floor from the warehousing setting floor, and after confirming their downward movement, goes to the downward return operation of step 25-2.

Figure 17:
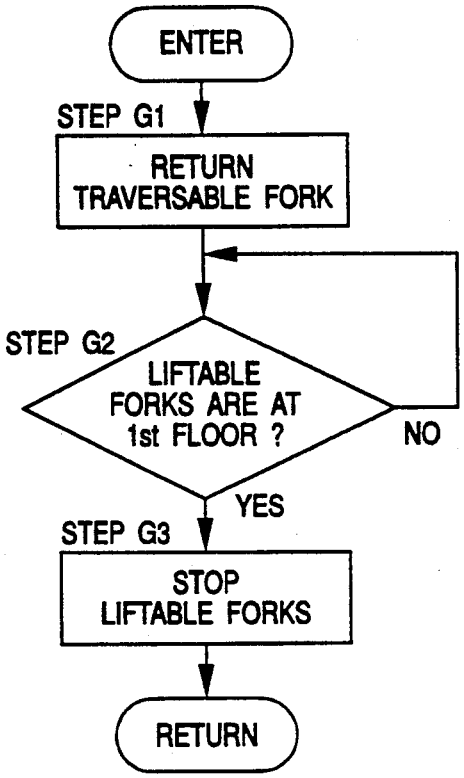

The downward return operation of step 25-2 is shown in FIG. 17. That is, the drive and control processing circuit A executes the processing operation of step G1 of causing the return movement of the traversable housing fork 20 as illustrated in FIG. 22*d* and the processing operation of step G2 of judging whether or not both liftable forks 5*a* and 5*b* have reached the first overground floor. If judged in step G2 that both liftable forks 5*a* and 5*b* have reached the first overground floor, the drive and control processing circuit A executes the processing operation of step G3 of stopping both liftable fork 5*a* and 5*b*.

Then, the drive and control processing circuit A executes the processing operation of step 26 of turning off the warehousing setting lamp, 35,38, turning on the stock indicator lamp, 32X,32Y, and setting the warehousing data indicative of the completion of the warehousing process done with respect to the warehousing setting floor in the RAM 29, whereby the overground warehousing process is completed.

In the case of the warehousing setting floor being underground, the drive and control processing circuit A judges in step 22 that it is the underground, and executes the processing operation of step 27 of confirming whether or not the operation switch 50 has been switched on. If judged that the operation switch 50 has been switched on, the drive and control processing circuit A goes to the lower transfer operation of step 28.

Figure 18:
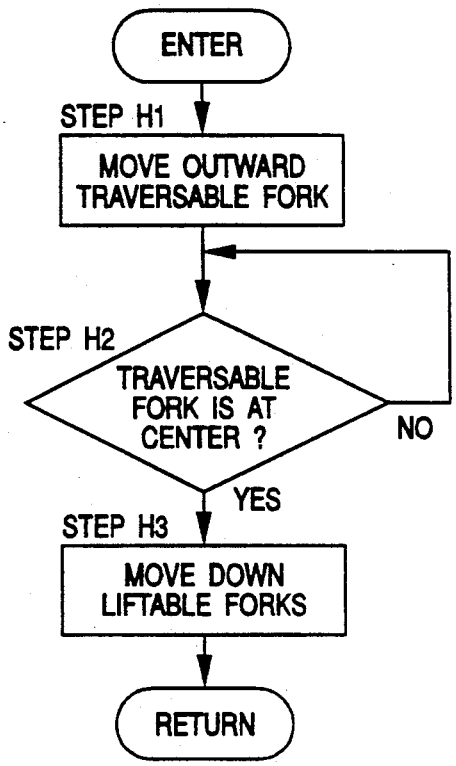

The lower transfer operation of step 28 is shown in FIG. 18. That is, the drive and control processing circuit A executes the processing operation of step H1 of causing the outward movement of the traversable housing fork 20 toward the center as illustrated in FIG. 23*a* and after confirming its arrival in step H2, executes the processing operation of step H3 of causing the downward movement of both liftable forks 5*a* and 5*b* as illustrated in FIG. 23*b*.

In case some additional floors are provided below the fifth underground floor and these additional floors are subjected to warehousing, in place of the processing operations of steps H1 through H3 above, the drive and control processing circuit A causes concurrently the traversable housing fork 20 to move outward toward the center position of the lift space E and both liftable forks 5*a* and 5*b* to move down.

Then, when both liftable forks 5*a* and 5*b* have reached the position spaced 50 cm on this side from the warehousing floor, it is confirmed whether the traversable housing fork 20 has reached the center position. If not, that is, in case the traversable housing fork 20 has not yet reached the center position; this meaning that the traversable housing fork 20 is out of order, both liftable forks 5*a* and 5*b* are stopped, the fault indicator lamp 43 is turned on, and the fault warning buzzer is energized, thereafter the process is terminated.

In cast there is nothing wrong, the drive and control processing circuit A executes the processing operation of step 29 hereinafter described.

If judged in step 29 that both liftable forks 5*a* and 5*b* have moved down 50 cm from the warehousing floor, the drive and control processing circuit A goes to the upward return operation of step 30.

Figure 19:
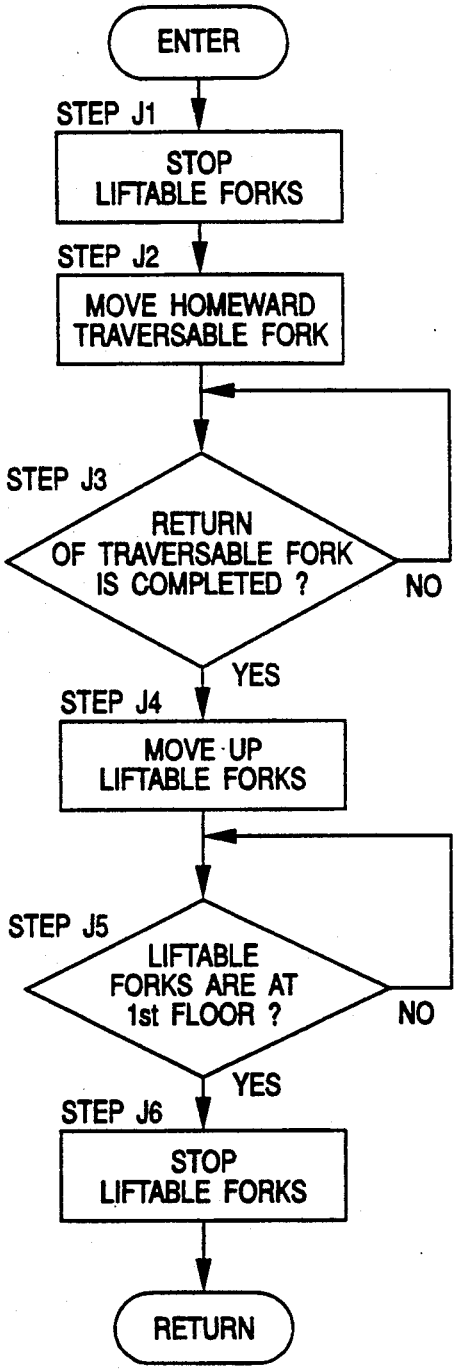
Figure 20:
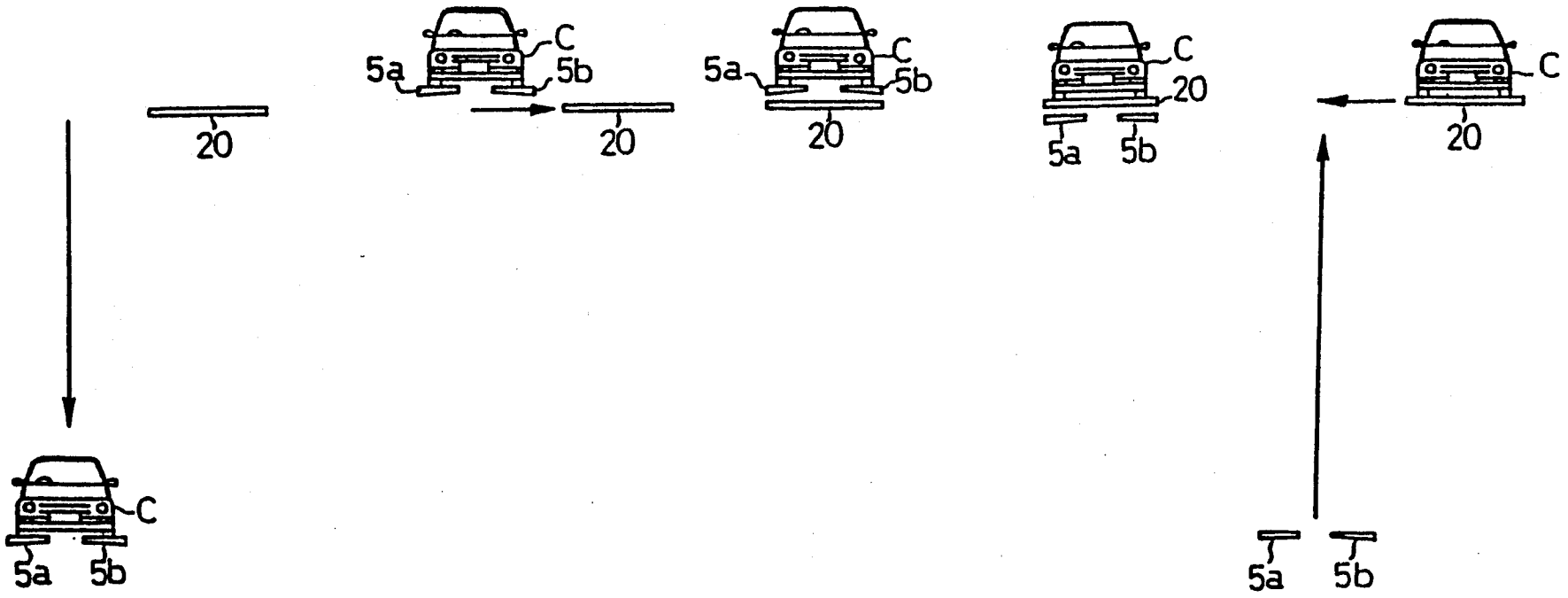
FIG. 20 is a diagram showing the upper delivery operation in combination of both liftable forks and a traversable housing fork.
Figure 21:
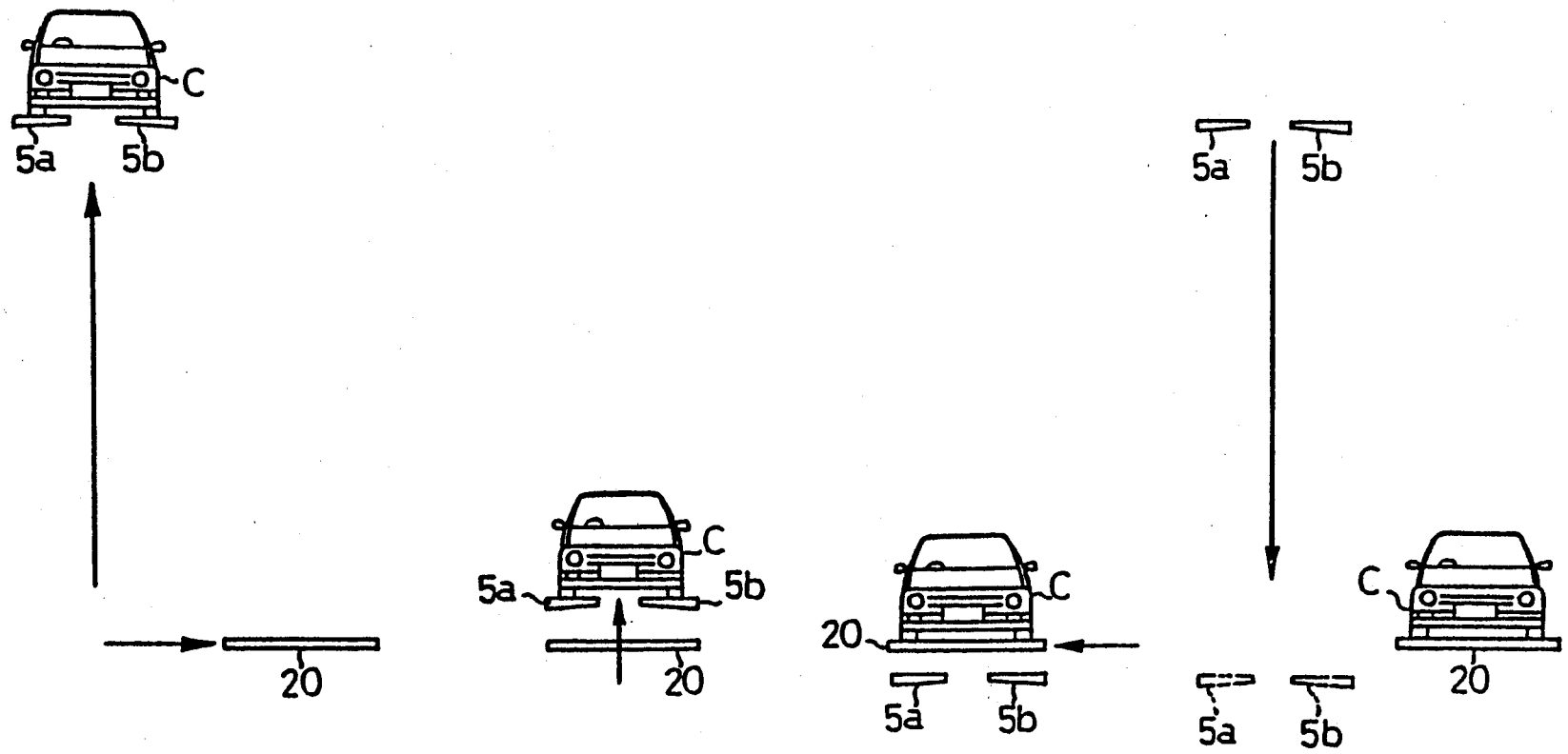
FIG. 21 is a diagram showing the lower delivery operation in combination of both liftable forks and the traversable housing fork.
Figure 22:
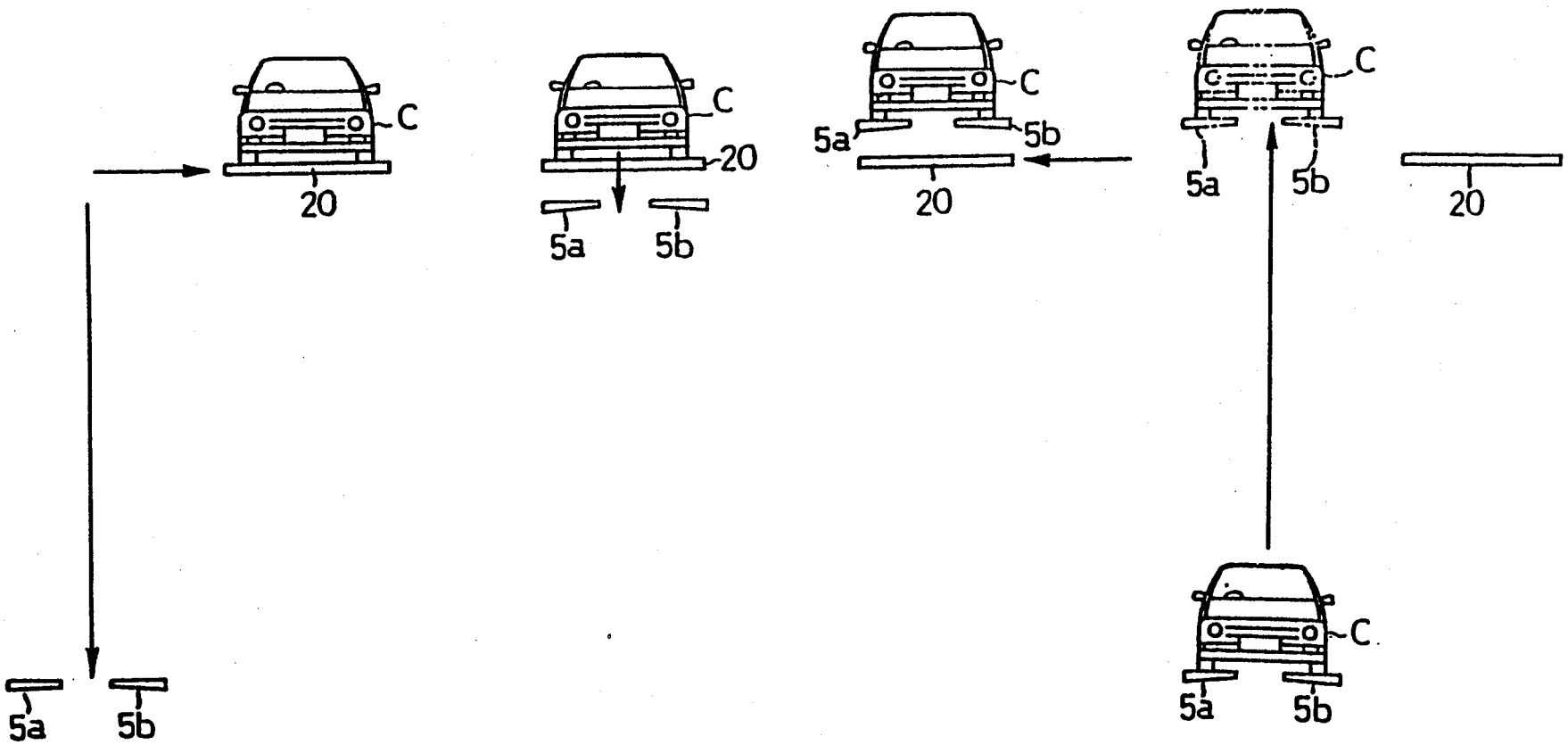
FIG. 22 is a diagram showing the upper warehousing operation in combination of both liftable forks and the traversable housing fork.
Figure 23:
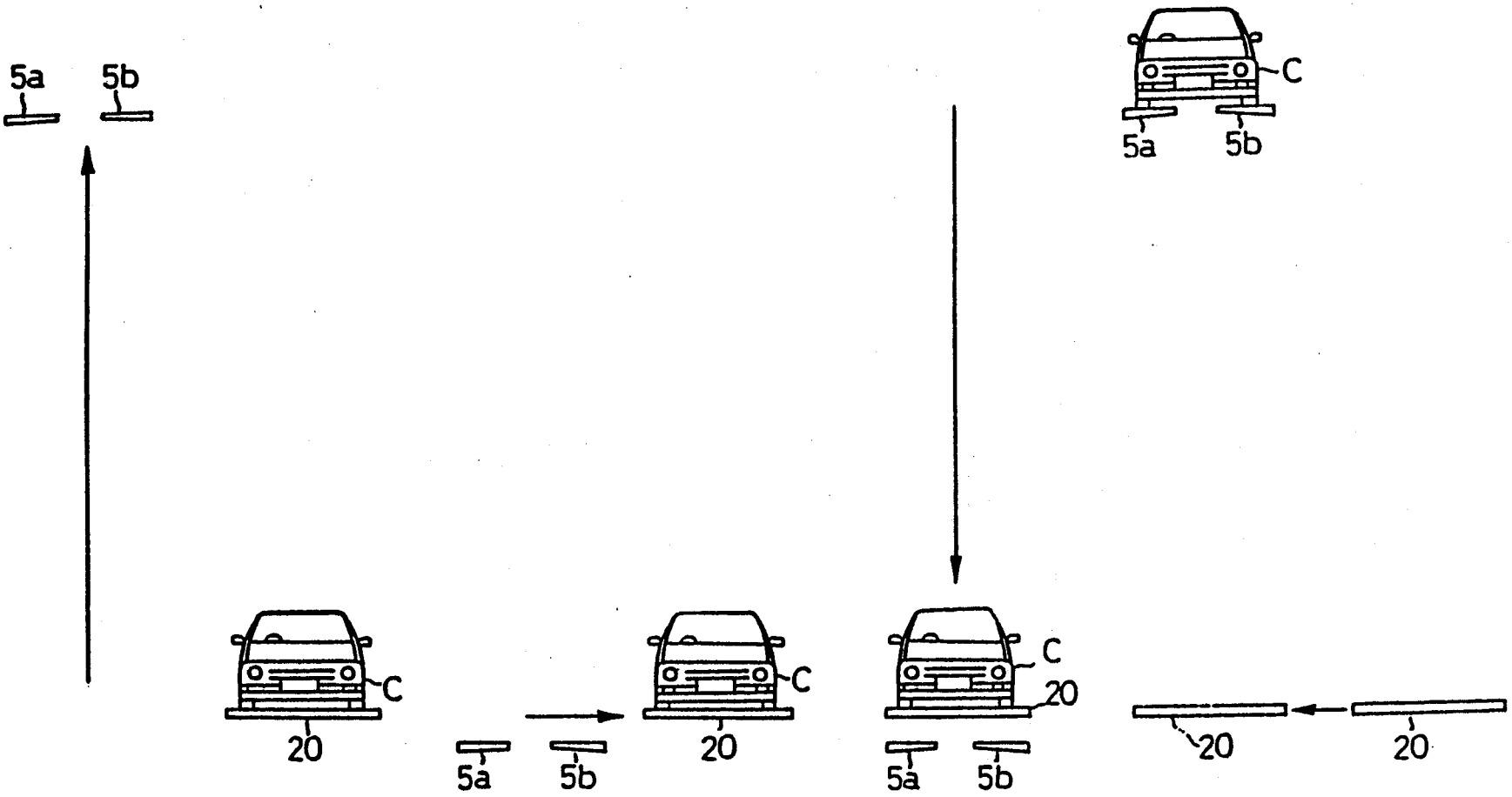
FIG. 23 is a diagram showing the lower warehousing operation in combination of both liftable forks and the traversable housing fork.

The upward return operation of step 30 is shown in FIG. 19. That is, the drive and control processing circuit A executes the processing operation of step J1 of stopping both liftable forks 5*a* and 5*b* and the processing operation of step J2 of causing the homeward movement of the traversable housing fork 20 as illustrated in FIG. 23*c*. Then, the drive and control processing circuit A executes the processing operation of step J3 of judging whether of not the return movement of the traversable housing fork 20 has been completed, and after confirming the completion of return movement, executes the processing operation of step J4 of causing the upward movement of both liftable forks 5*a* and 5*b* as illustrated in FIG. 23*d*.

Then, the drive and control processing circuit A executes the processing operation of step J5 of judging whether or not both liftable forks 5*a* and 5*b* have reached the first overground floor, and after confirming their arrival, executes the processing operation of step J6 of stopping both liftable forks 5*a* and 5*b*.

Thereafter, the drive and control processing circuit A executes, similarly to the case of step 26, the processing operation of step 31 of turning off the warehousing setting lamp, 35,38, turning on the stock indicator lamp, 32X,32Y, and setting the warehousing data in the RAM 29, whereby the underground warehousing process is completed.

Next, the processing operation of the drive and control processing circuit A in performing the process of underground concurrent warehousing and delivery will be described.

This processing operation is to achieve successive delivery of other cars C housed in the underground housing spaces, X,Y, before both liftable forks 5*a* and 5*b* are returned again to the first overground floor after the warehousing process was performed in the underground.

After confirming the underground warehousing in step 22, the drive and control processing circuit A judges once in step 32 as to whether or not the warehousing/delivery setting switch, 34,37, has been pushed before switching on the operation switch 50 in step 27. Up to the time the warehousing/delivery setting switch, 34,37, is pushed, the drive and control processing circuit A repeats the processing operation of returning again to step 27.

If judged in step 32 that the warehousing/delivery setting switch, 34,37, has been pushed, the drive and control processing circuit A executes the processing operation of step 33 of judging whether or not the designated delivery setting floor is underground. In case the delivery setting floor is not underground, the drive and control processing circuit A executes the processing operation of returning again to step 27. If the delivery setting floor is underground, the drive and control processing circuit A executes the processing operation of step 34 of judging on the basis of the output of the stock sensor 23 as to whether or not the car C exists in the housing space, X,Y.

If judged in step 34 that no car C exists in the housing space, X,Y, the drive and control processing circuit A executes the processing operation of step 35 of confirming again on the basis of the data of the RAM 29 as to whether or not the car C exists in the housing space, X,Y. If judged that there is no car C, the processing operation of step 27 is again executed because it is impossible to perform the delivery process from the housing space, X,Y.

If the drive and control processing circuit A judges in step 35 that the car C exists in the housing space, X,Y, even though it was judged in step 34 that no car C exists in the housing space, X,Y, it is judged that either the stock sensor 23 or the RAM 29 is in failure. Accordingly, the drive and control processing circuit A executes the processing operation of step 36 of turning on the fault indicator lamp 43 and energizing the fault warning buzzer 45, thereafter the process is terminated.

If judged in step 34 that the car C exists in the housing space, X,Y, the drive and control processing circuit A executes the processing operation of step 37 of confirming again on the basis of the data of the RAM 29 as to whether or not the car C exists in the housing space, X,Y. If judged in step 37 that no car C exists in the housing space, X,Y, even though it was judged in step 34 that the car C exists in the housing space, X,Y, the drive and control processing circuit A executes the processing operation of step 36, thereafter the process is terminated.

On the contrary, if judged in step 37 that the car C exists in the housing space, X,Y, the drive and control processing circuit A executes the processing operation of turning on the delivery setting lamp, 36,39, corresponding to that housing space, X,Y, and the processing operation of step 38 of confirming whether or not the operation switch 50 has been switched on. If judged that the operation switch 50 has been switched on, it goes to the lower transfer operation, or to step 39 shown in FIG. 9. This step 39 is the upward return operation shown in FIG. 19 and already described above, hence, its description is omitted here.

The drive and control processing circuit A having completed the processing operation of step 39 then executes the processing operation of step 40 of judging whether or not both liftable forks 5*a* and 5*b* have moved down one floor from the warehousing floor just processed, and after confirming that both liftable forks 5*a* and 5*b* have moved down one floor, executes the processing operation of step 41 of judging whether or not the delivery setting floor then to be subjected to the delivery process is above that warehousing floor.

Then, if judged that the next delivery setting floor is higher than that warehousing floor, the drive and control processing circuit A executes the processing operation of step 42 of concurrently stopping both liftable forks 5*a* and 5*b* and returning the traversable housing fork 20 to the initial position. After executing the processing operation of step 43 of confirming the return movement of the traversable housing fork 20, the drive and control processing circuit A executes the processing operation of step 44 of turning off the warehousing setting lamp, 35,38, turning on the stock indicator lamp, 32X,32Y, both corresponding to that warehousing floor, and setting the warehousing data corresponding to that warehousing floor in the RAM 29.

Then, after the execution of the processing operation of step 44 and the completion of the warehousing process, the drive and control processing circuit A goes to the upper reception operation of step 45. This step 45 is the upper reception operation shown in FIG. 13 and already described above, hence, its description is omitted here.

After the completion of the processing operation of step 45, the drive and control processing circuit A executes the processing operation of step 46 of judging whether or not both liftable forks 5*a* and 5*b* have moved up 50 cm from the delivery floor, and goes to the lower redemption operation of step 47. This step 47 is the lower redemption operation shown in FIG. 15 and already described above, hence, its description is omitted here.

After the completion of the processing operation of step 47, the drive and control processing circuit A executes the processing operation of step 48 of turning off the delivery setting lamp, 36,39, turning off the stock indicator lamp, 32X,32Y; both corresponding to the delivery floor, and clearing the warehousing data corresponding to the delivery floor and stored in the RAM 29, whereby the underground concurrent warehousing and delivery process is completed.

On the other hand, if judged in the processing operation of step 41 that the next delivery setting floor is below the warehousing floor, the drive and control processing circuit A executes the processing operation of step 49 of returning the traversable housing fork 20 to the intial position. Then, the drive and control processing circuit A executes the processing operation of step 50 of turning off the warehousing setting lamp, 35,38, turning on the stock indicator lamp, 32X,32Y, and setting the warehousing data corresponding to the warehousing floor in the RAM 29.

Further, the drive and control processing circuit A executes the processing operation of step 51 of stopping both liftable forks 5*a* and 5*b* when they have moved down one floor from the warehousing floor, and executes the processing operations of step 45 and so forth, whereby the underground concurrent warehousing and delivery process is completed.

Next, the processing operation of the drive and control processing circuit A in performing the process of overground concurrent warehousing and delivery will be described.

This processing operation is to achieve successive delivery of other cars C housed in the overground housing spaces, X,Y, before both liftable forks 5*a* and 5*b* are returned again to the first overground floor after the warehousing process was performed in the overground.

After confirming in step 22 the overground warehousing, the drive and control processing circuit A judges once in step 52 as to whether or not the warehousing/delivery setting switch, 34,37, has been pushed before executing in step 23 the turn-on of the operation switch 50. Up to the time the warehousing/delivery setting switch, 34, 37, is pushed, the drive and control processing circuit A repeats the processing operation of returning again to step 23.

If judged in step 52 that the warehousing/delivery setting switch, 34,37 has been pushed, the drive and control processing circuit A executes the processing operation of step 53 of judging whether or not the designated delivery setting floor is overground.

In case the delivery setting floor is not overground, the drive and control processing circuit A executes the processing operation of returning again to step 23. If the delivery setting floor is overground, the drive and control processing circuit A executes the processing operation of step 54 of judging on the basis of the output of the stock sensor 23 as to whether or not the car C exists in the housing space, X,Y. If judged in step 54 that no car C exists in the housing space, X,Y, the drive and control processing circuit A executes the processing operation of step 55 of confirming again on the basis of the data of the RAM 29 as to whether or not the car C exists in the housing space, X,Y. If judged that there is no car C, the processing operation of step 23 is again executed because it is impossible to perform the delivery process from the housing space, X,Y.

If the drive and control processing circuit A judges in step 55 that the car C exists in the housing space, X,Y, even though it was judged in step 54 that no car C exists in the housing space, X,Y, it is judged that either the stock sensor 23 or the RAM 29 is in failure. Accordingly, the drive and control processing circuit A executes the processing operation of step 56 of turning on the fault indicator lamp 43 and energizing the fault warning buzzer 45, thereafter the process is terminated.

If judged in step 54 that the car C exists in the housing space, X,Y, the drive and control processing circuit A executes the processing operation of step 57 of confirming again on the basis of the data of the Ram 29 as to whether or not the car C exists in the housing space, X,Y. If judged in step 57 that no car C exists in the housing space, X,Y, even though it was judged in step 54 that the car C exists in the housing space, X,Y, the drive and control processing circuit A executes the processing operation of step 54, thereafter the process is terminated.

On the contrary, if judged in step 57 that the car C exists in the housing space, X,Y, the drive and control processing circuit A turns on the delivery setting lamp, 36,39, corresponding to that housing space, X,Y, and executes the processing operation of step 58 of confirming whether or not the operation switch 50 has been switched on. If judged that the operation switch 50 has been switched on, it goes to the upper transfer operation, or to step 59 shown in FIG. 10. This step 59 is the upper transfer operation shown in FIG. 16 and already described above, hence, its description is omitted here.

The drive and control processing circuit A having completed the processing operation of step 59 then executes the processing operation of step 60 of judging whether or not both liftable forks 5*a* and 5*b* have moved down one floor from the warehousing floor just processing, and after confirming that both liftable forks 5*a* and 5*b* have moved down one floor, executes the processing operation of step 61 of judging whether or not the delivery setting floor then to be subjected to the delivery process is above that warehousing floor.

Then, if judged that the next delivery setting floor is above the warehousing floor, the drive and control processing circuit A executes the processing operation of step 62 of concurrently stopping both liftable forks 5*a* and 5*b* and returning the traversable housing fork 20 to the initial position. After executing the processing operation of step 63 of confirming the return movement of the traversable housing fork 20, the drive and control processing circuit A executes the processing operation of step 64 of turning off the warehousing setting lamp, 35 38, turning on the stock indicator lamp, 32X,32Y; both corresponding to that warehousing floor, and setting the warehousing data corresponding to that warehousing floor in the Ram 29.

Then, after the execution of the processing operation of step 64 and the completion of the warehousing process, the drive and control processing circuit A goes to the upper reception operation of step 65. This step 65 is the upper reception operation shown in FIG. 13 and already described above, hence, its description is omitted here.

After the completion of the processing operation of step 65, the drive and control processing circuit A executes the processing operation of step 66 of judging whether or not both liftable forks 5*a* and 5*b* have moved up 50 cm from the designated delivery floor, and goes to the lower redemption operation of step 67. This step 67 is the lower redemption operation shown in FIG. 12 and already described above, hence, its description is omitted here.

After the completion of the processing operation of step 67, the drive and control processing circuit A executes the processing operation of step 68 of turning off the delivery setting lamp, 36,39 turning off the stock indicator lamp, 32X,32Y; both corresponding to that delivery floor, and clearing the warehousing data corresponding to that delivery floor and stored in the RAM 29, whereby the overground concurrent warehousing and delivery process is completed.

On the other hand, if judged in the processing operation of step 61 that the next delivery setting floor is below the warehousing floor, the drive and control processing circuit A executes the processing operation of step 69 of returning the traversable housing fork 20 to the initial position. Then, the drive and control processing circuit A executes the processing operation of step 70 of turning off the warehousing setting lamp, 35,38, turning on the stock indicator lamp, 32X,32Y, and setting the warehousing data corresponding to the warehousing floor in the RAM 29.

Further, the drive and control processing circuit A executes the processing operation of step 71 of stopping both liftable forks 5*a* and 5*b* and the processing operations of step 65 and so forth, whereby the overground concurrent warehousing and delivery process is completed.

As described hereinabove in greater detail, in the aforementioned embodiment, the drive and control processing circuit A treats the warehousing/delivery setting switch, 34,37, actuated by the worker as the effective warehousing command switch only if judged that no car C exists in the housing space, X,Y, after examining on the basis of the stock sensors 23 and the RAM 29 as to whether or not the car C exists in the housing space, X,Y, and that the car C exists in the drive-in station E1.

Accordingly, even when the worker erroneously operates the warehousing/delivery setting switch, 34,37, is spite of the fact that the car C already exists in the housing space, X,Y, the drive and control processing circuit A never executes the warehousing operation, thus, the system is very safe.

Further, when no car C exists in the drive-in station E1, the drive and control processing circuit A never executes the warehousing operation, thus, it is unnecessary to worry about a useless warehousing operation.

Similarly to the case above, the drive and control processing circuit A treats the warehousing/delivery setting switch, 34,37, actuated by the worker as the delivery command switch only if judged that the car C exists in the housing space, X,Y, after examining on the basis of the stock sensor 23 and the RAM 29 as to whether or not the car C exists in the housing space, X,Y, and that no car C exists in the drive-in station E1. Accordingly, even when the worker erroneously operates the warehousing/delivery setting switch, 34,37, in spite of the fact that no car C exists in the housing space, X,Y, the drive and control processing circuit A never executes the delivery operation, thus, the system is very safe. Further, when the car C exists in the housing space, X,Y, but another car C exists in the drive-in station E1, the drive and control processing circuit A never executes the delivery operation, thus, the system is very safe.

Further, the drive and control processing circuit A causes, in its processing operation, the upward/downward movement of a given distance (50 cm or one interfloor spacing) of both liftable forks 5*a* and 5*b*, and if judged that the outward movement of the traversable housing fork 20 toward the center position of the lift space E/ the homeward movement thereof into the housing space, X,Y, is permitted, causes the outward-/homeward movement of the traversable housing fork 20 concurrently and parallelly with the processing operation of moving up/down both liftable forks 5*a* and 5*b*. Accordingly, the time necessary for the foregoing processing operation can be shortened.

Also, in the course of the upper reception operation, if the delivery setting floor is spaced six floors or more from the first overground floor, the drive and control processing circuit A starts the upward movement of both liftable forks 5*a* and 5*b* concurrently with the start of the outward movement of the traversable housing fork 20 toward the center, hence, the time necessary for the foregoing processing operation can be shortened as compared with a system wherein both liftable forks 5*a* and 5*b* are caused to move up after the completion of arrival of the traversable housing fork 20 at the center.

Further, in executing the foregoing processing operation, the drive and control processing circuit A confirms, when both liftable forks 5*a* and 5*b* have reached the position 50 cm lower than the traversable housing fork 20, the arrival of the traversable housing fork 20 at the center. Subsequently, the drive and control processing circuit A continues the foregoing reception operation only if the traversable housing fork 20 has reached the center without any trouble. If an accident happens on the traversable housing fork 20, it can immediately stop the upward movement of both liftable forks 5*a* and 5*b* to avoid danger.

In the course of the overground concurrent warehousing and delivery operation/the underground concurrent warehousing and delivery operation, the drive and control processing circuit A performs, before both liftable forks 5*a* and 5*b* with no car C mounted thereon return to the first overground floor after both liftable forks 5*a* and 5*b* have completed the warehousing operation, the delivery operation sequentially, and then returns both liftable forks 5*a* and 5*b* to the first overground floor. Accordingly, any excessive processing operation of both liftable forks 5*a* and 5*b* and of the traversable housing fork 20 can be omitted, the time necessary for the processing operation can be shortened, and the control work of the worker can be simplified.

The automatic door D is left open only when both liftable forks 5*a* and 5*b* are in the drive-in station E1 and the car C is mounted on these liftable forks; otherwise, the door D is always closed. Accordingly, the passenger of the car C driven into the drive-in station E1 for the purpose of parking can safely go in and out of the anteroom S. Therefore, if the passenger waits inside this anteroom S for the car C which was called up to be delivered from the housing space, X,Y, he cannot be distressed irrespective of the weather or season and is very safe.

In case the first door-open preventing member 60 and second door-open preventing member 61 are equipped on the fixing member 2 or the traversable housing fork 20, even if the door not perfectly closed opens due to vibrations arising during the vertical or traversal movement of the car C by any chance, the trouble that the doors and/or facilities are damaged can be prevented from occurring by means of the fixing member 2 or the traversable housing fork 20, hence, the safety can be enhanced further.

Since the two liftable forks 5*a* and 5*b* are separated from each other laterally, the weight of the load or the car is evenly supported thereby, and their structure is simplified, thereby resulting in a decrease of the manufacturing cost. Further, different from the conventional apparatus, according to the present invention, (without need of stopping the fork pieces 3 of both liftable forks 5*a* and 5*b* and the fork pieces 17 of the traversable housing fork 20 at correct positions of substantially identical height at the time of transfer of the car C), the transfer of the car C can be achieved only by causing both liftable forks 5*a* and 5*b* to continuously intersect from above or below with the traversable housing fork 20 previously held on standby within the lift space E. Accordingly, it is not necessary to control accurately the height of both liftable forks 5*a* and 5*b* at the time of transfer of the car C, and the time necessary for the transfer operation can be shortened very advantageously.

Of course, the present invention should not be limited to the aforementioned embodiment. For example, the present invention can be applied to another kind of three dimensional housing apparatus for housing articles other than the car C. Both liftable forks 5*a* and 5*b* may be lifted by wires in place of the chains. The present apparatus operates in such a manner that both liftable forks 5*a* and 5*b* and the traversable housing fork 20 vertically intersect with each other in the lift space E to transfer the car C therebetween, and the traversable housing fork 20 is returned into the housing space, X,Y, after both liftable forks 5*a* and 5*b* have moved up/down a given distance. In this respect, the given distance may be made longer or shorter than 50 cm.

Figure 31:
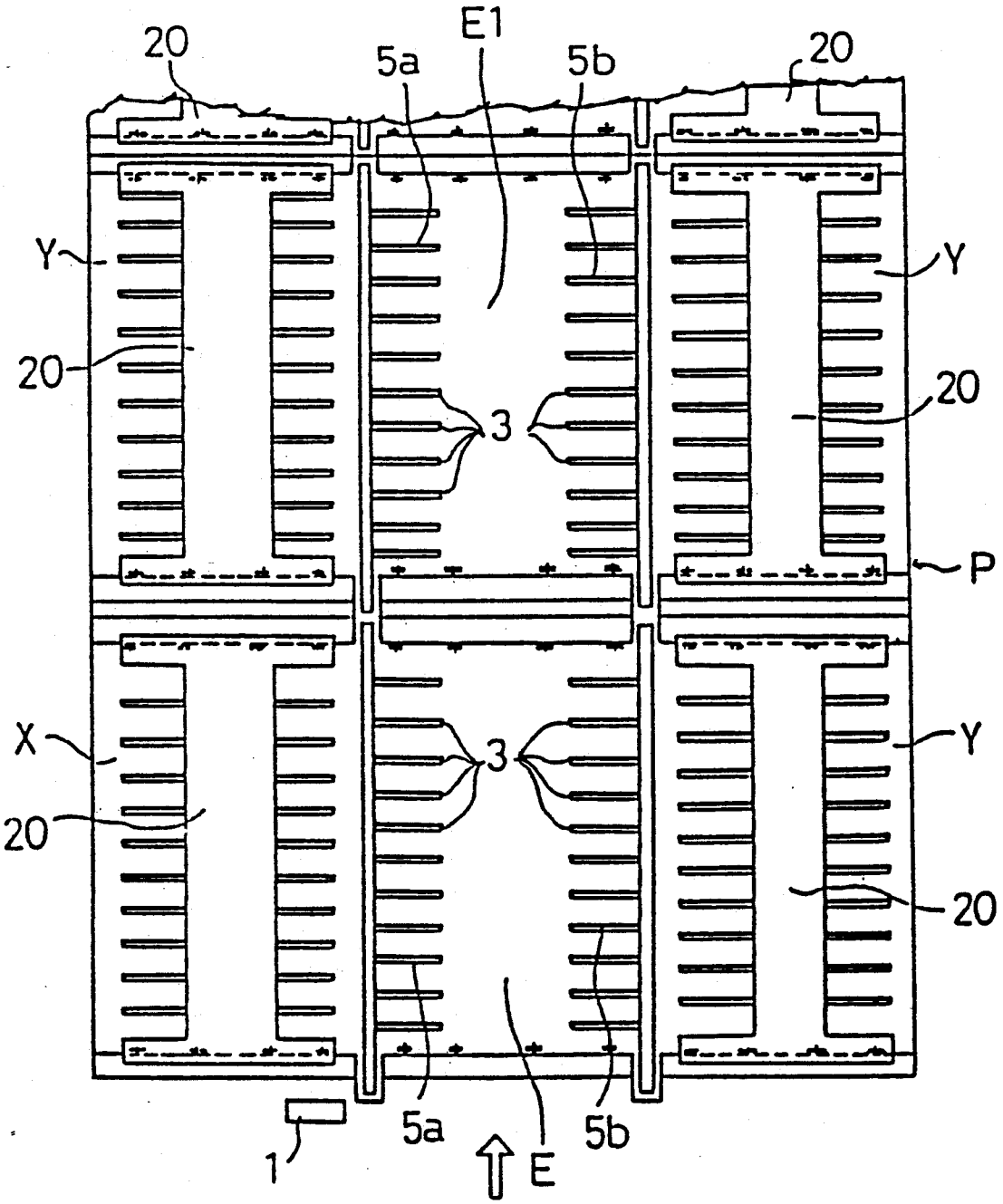
FIG. 31 is a plan view showing a modification of the first embodiment of the three dimensional tower which is provided with a plurality of rows of housing spaces and lift spaces.

The three dimensional housing tower P may be implemented in such a configuration as shown in FIG. 31 wherein a number of rows, each comprising housing spaces X and Y and a lift space E, are arranged behind the first row comprising the housing spaces X and Y and the lift space E.

Figure 32:
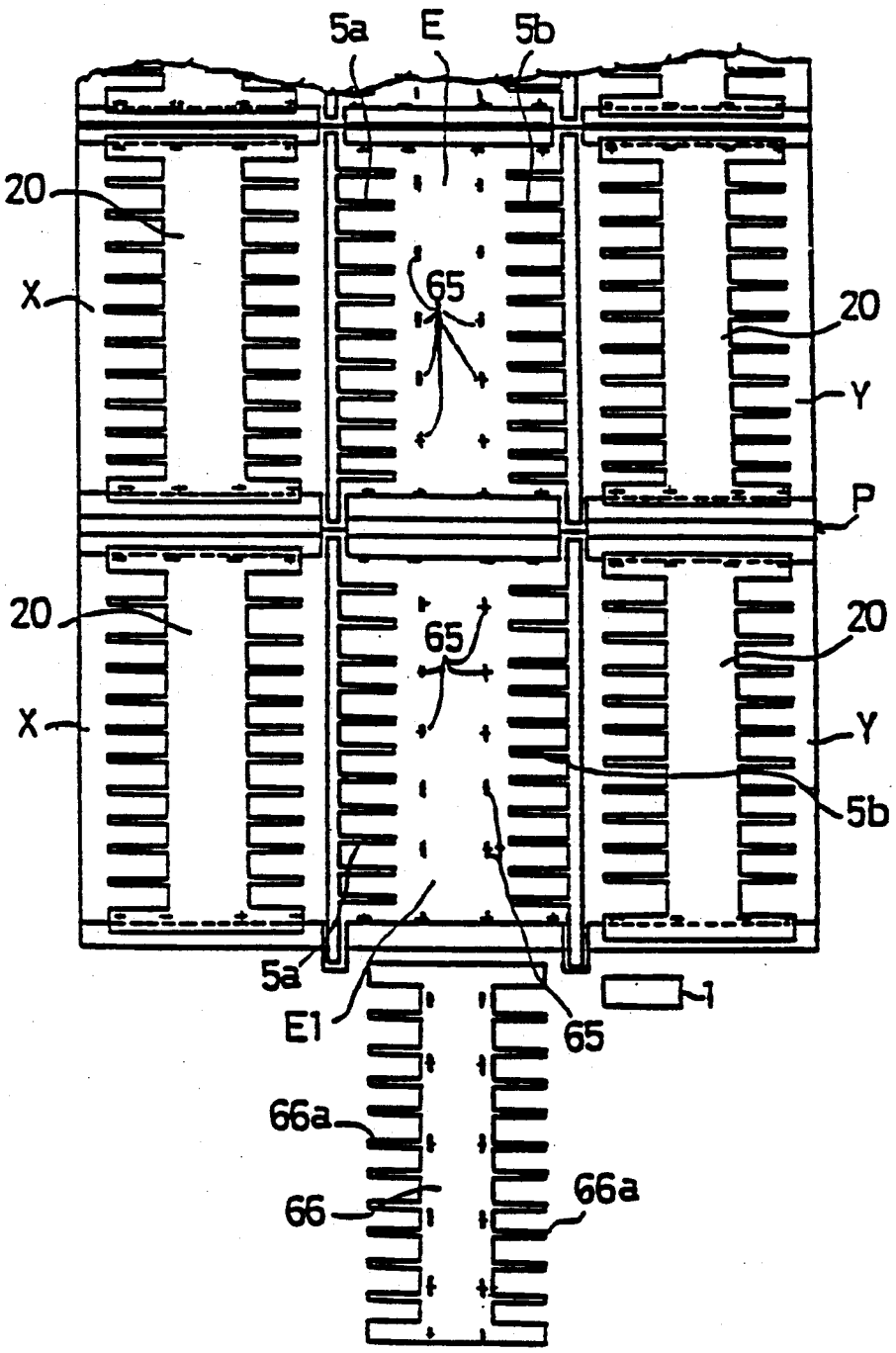
FIG. 32 is a plan view showing another modification of the above.
Figure 33:
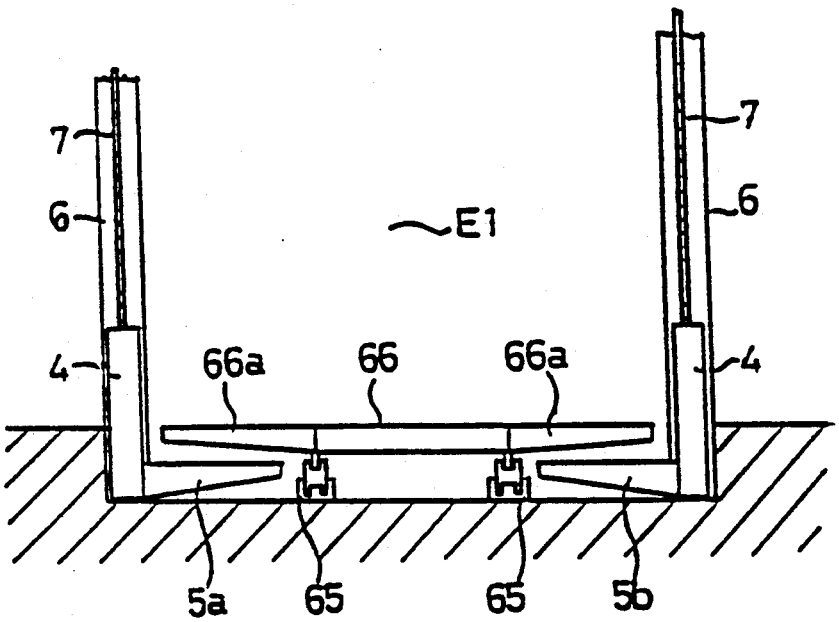
FIG. 33 is a front view showing an important portion of the tower shown in FIG. 32.

Another type of tower P shown in FIGS. 32 and 33 is partly similar to that of FIG. 31 in that a number of rows, each comprising housing spaces X and Y and a lift space E, are arranged behind the first row comprising the housing spaces X and Y and the lift space E. In addition, a plurality of wheels 65 are distributed in the front-rear direction of the car C in the central portion of each drive-in station E1 and in the area located in front of the drive-in station E1 of the foremost row. On these wheels 65 is mounted a transport truck 66 equipped with fork pieces 66*a* on both sides thereof which are capable of transferring the car C with both liftable forks 5*a* and 5*b* while vertically intersecting therewith in the lift space E as is the case of the traversable housing fork 20. The truck 66 may be made movable by means of a motor (not shown) provided in connection with the wheels 65 from the area in front of the foremost drive-in section E1 to a desired drive-in station E1 while mounting the car C on its fork pieces 66*a*. If so implemented, the car C can smoothly be driven in and out of the drive-in stations E1.

Figure 35:
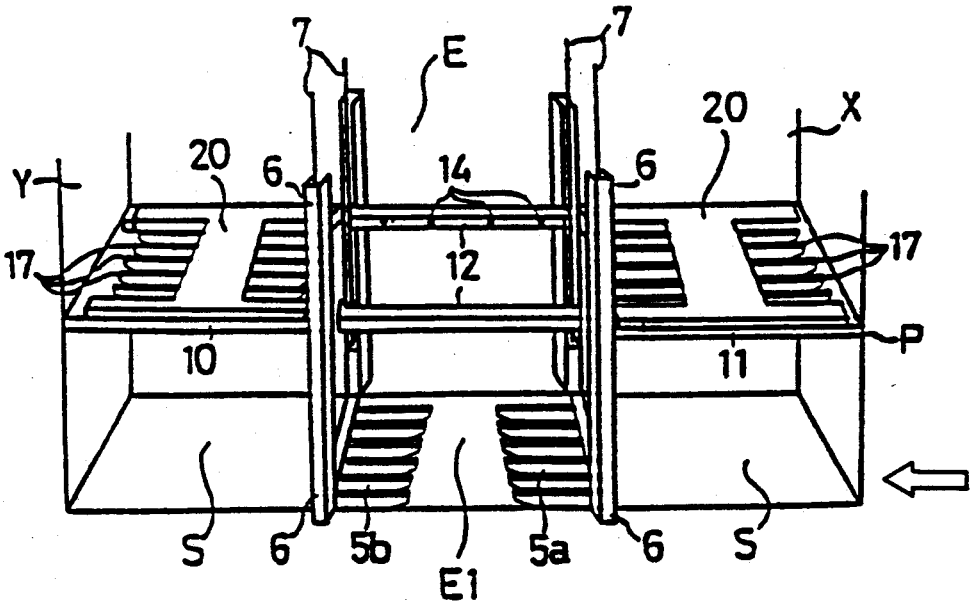
FIG. 35 is a perspective view, as viewed from the side, of the three dimensional housing tower having housing spaces provided on the front and rear sides of the lift space.
Figure 34:
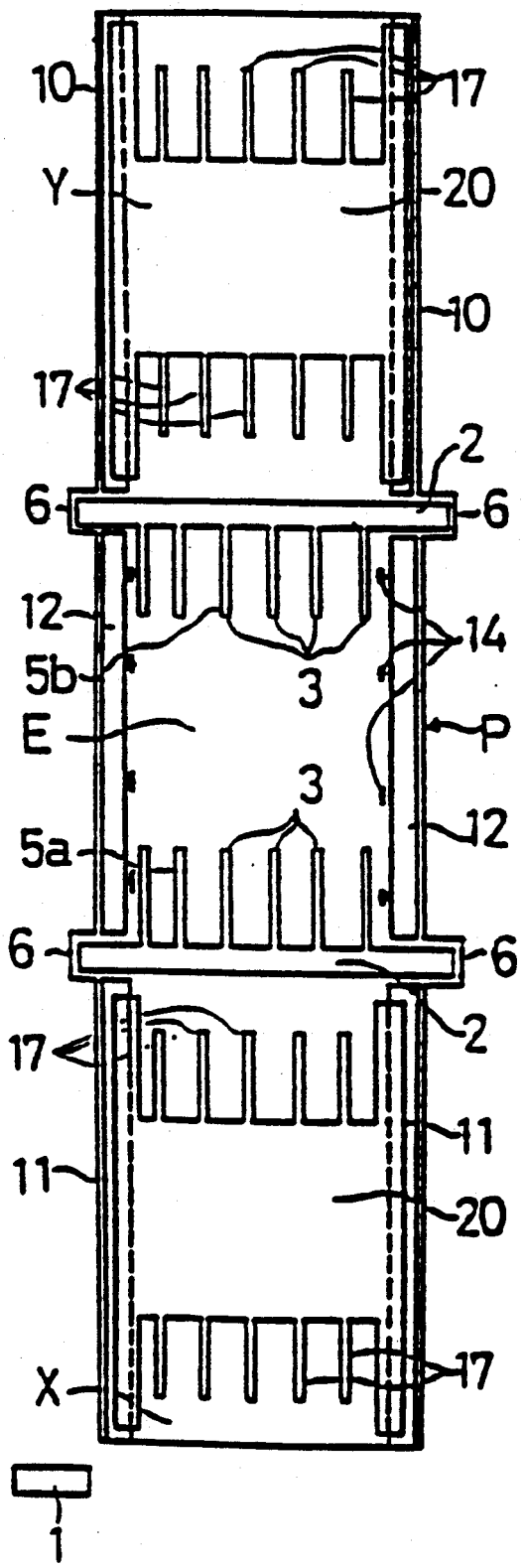
FIG. 34 is a plan view showing a three dimensional housing tower having housing spaces provided on the front and rear sides of the lift space.

The three dimensional housing tower P may further be implemented in such a configuration as shown in FIGS. 34 and 35 wherein the housing spaces X and Y are located on the front side and the rear side of the lift space E. Specifically, at the left and right edges each of the housing spaces X and Y and the lift space E are provided traverse roller frames 10, 11, and 12 equipped with pulleys 14, similar to the aforementioned traverse roller frames 10, 11, and 12. A traversable housing fork 20 is movable on these traverse roller frames 10, 11, and 12 in the longitudinal direction so that it can effect its outward/homeward movement between the housing space, X,Y, and the lift space E.

In addition, in the lift space E is provided a liftable fork 5*a* comprising a fixing member 2 whose vertical movement is guided by lift guide rails 6 provided on both sides in the rear section of the lift space E and a plurality of parallel fork pieces 3 projecting from the fixing member 2 in the lengthwise direction of the drive-in station E1. In the lift space E is also provided another liftable fork 5*b* comprising a fixing member 2 whose vertical movement is guided by lift guide rails 6 provided on both sides in the front section of the lift space E and a plurality of parallel fork pieces 3 projecting from the fixing member 2 in the lengthwise direction of the drive-in station E1.

The transfer of the car C is achieved by causing the traversable housing fork 20 normally in the housing space, X,Y, to vertically intersect with these liftable forks in the lift space E.

Figure 36:
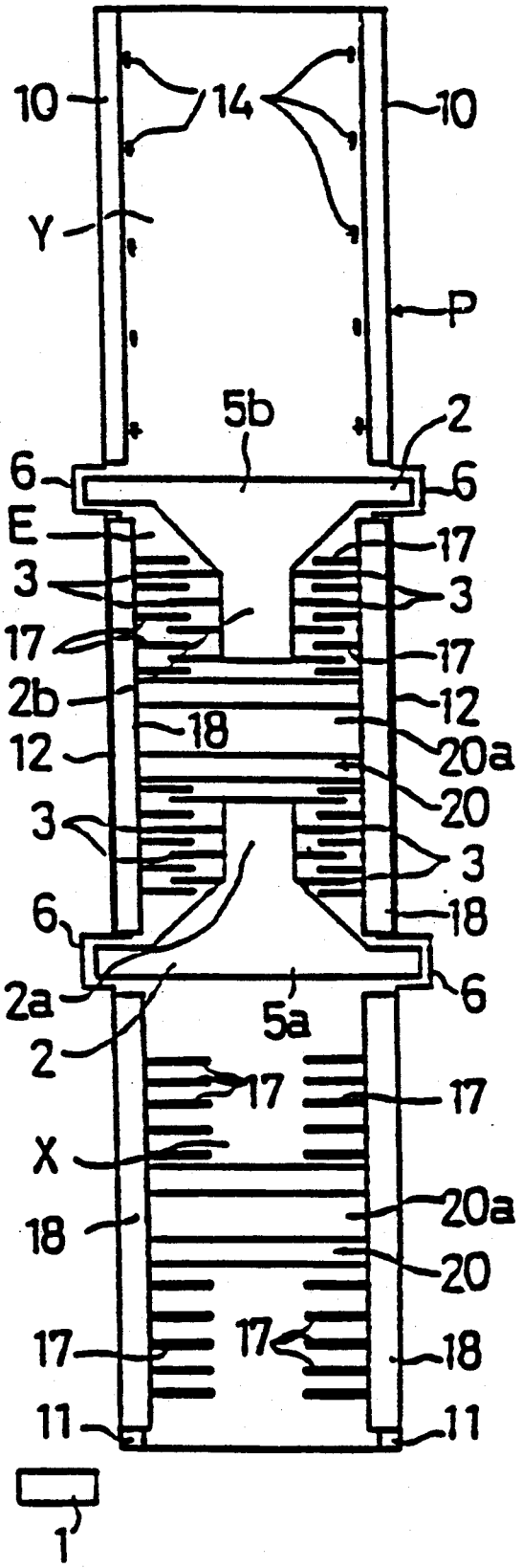
FIG. 36 is a plan view showing modification of the three dimensional housing tower having housing spaces provided on the front and rear sides of the lift space.

Likely to the case of FIG. 34, the three dimensional housing tower P may be implemented in such a configuration as shown in FIG. 36 wherein the lift space E and housing spaces X and Y are arranged in the front-rear direction. Specifically, each fixing member 2 has a fork piece supporting section, 2*a*,2*b*, projecting from a central portion of the inside surface of a respective fixing member 2 with a certain gap left between the distal ends of these fork piece supporting sections 2*a* and 2*b*. A plurality of fork pieces 3 are fixed at right angles to these fork piece supporting sections 2*a* and 2*b*. In addition, a traversable housing fork 20, which is mounted on the traverse roller frames 10, 11, 12 and movable outward/homeward between the housing space, X, Y, and the lift space E, has a connecting section 20*a* for connecting together the center portions of both supporting frames 18 thereof and a plurality of fork pieces 17 projecting at right angles from both supporting frames 18.

In the lift space E, the traversable housing fork 20 and both liftable forks 5*a* and 5*b* can vertically intersect with each other under the condition that the connecting section 20*a* matches with the gap between the distal ends of the fork piece supporting sections 2*a* and 2*b* and that the fork pieces 3 and the fork pieces 17 are mutually alternate, whereby the transfer of the car C can be achieved.

The foregoing configuration may further be modified in such a manner that an additional housing space Y is provided in the rear of the housing space Y originally provided in the rear of the lift space E, and the transsfer of the car C is performed further from the first rear-side housing space Y to the second rear-side housing space Y.

In place of using as the anteroom of the driver, the anteroom S may be used as the place of shelter of the car C to make effective the transfer of the car C onto both liftable forks 5*a* and 5*b* in the drive-in station E1.

SECOND EMBODIMENT

The different point of a second embodiment from the first embodiment only will now be described.

Figure 37:
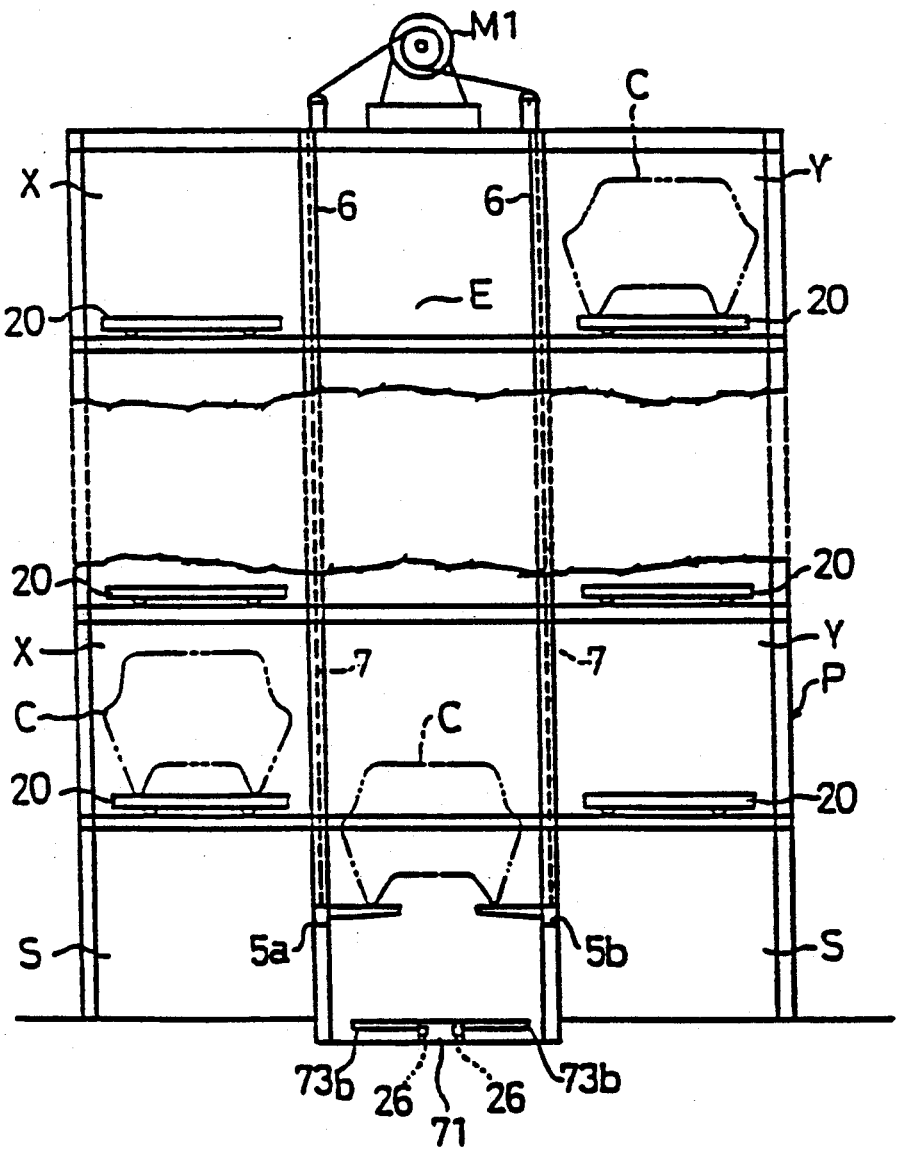
FIG. 37 is a front view showing a second embodiment of the three dimensional housing tower.
Figure 38:
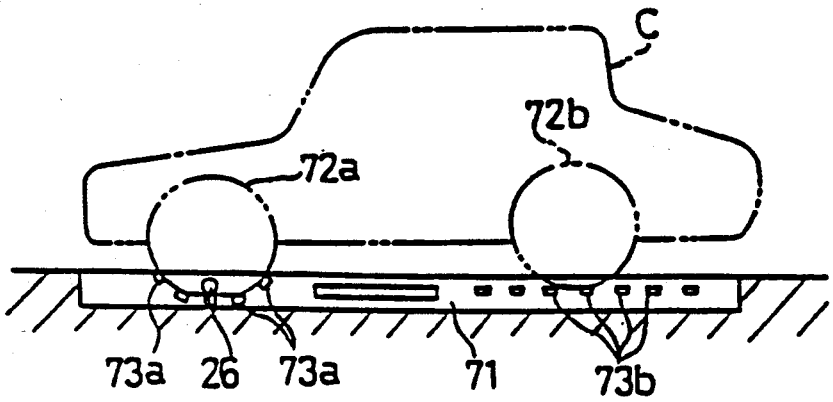
FIG. 38 is a side view showing a stationary drive-in base of the above.

This secondd embodiment uses, in place of the three dimensional housing tower P of the first embodiment, a three dimensional housing tower P shown in FIG. 37 which is devoid of the floors below the drive-in station E1 with a stationary drive-in base 71 being provided in the center of the ground of the drive-in station E1. As shown in FIG. 38, a plurality of support fork pieces 73*a* and 73*b* are provided projectingly on both side surfaces of the stationary drive-in base 71 in portions where the front wheels 72*a* and rear wheels 72*b* of the car C are located when the car is mounted on the stationary drive-in base 71. Specifically, the support fork pieces 73*a* corresponding to the front wheels 72*a* are distributed on both side surfaces of the stationary drive-in base 71 so as to form a curved face compatible with the peripheral surface of the front wheel 72*a*, and an entrance warehousing sensor 26 dor detecting the presence of the front wheel 72*a* is provided on either side of the stationary drive-in base 71 at a position corresponding to the curved arrangement.

Of course, these support fork pieces 73*a* and 73*b* are distributed such that when both liftable forks 5*a* and 5*b* are positioned in the drive-in station E1, they alternately intersect with the fork pieces 3 of both liftable forks to effect the transfer of the car C.

Figure 39:
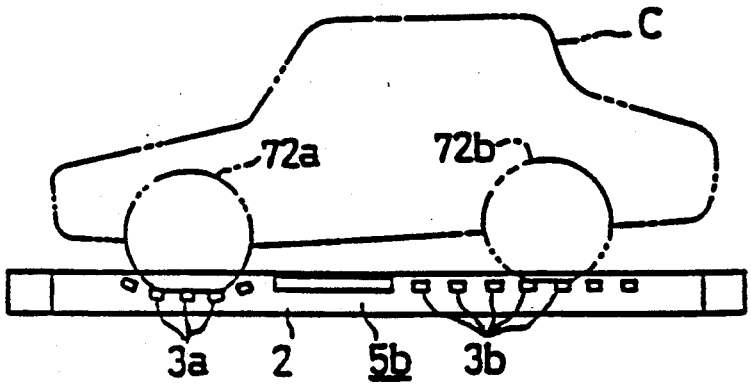
FIG. 39 is a side view showing a liftable fork.

It is also possible as shown in FIG. 39 to distribute and attach the fork pieces 3*a* on the front-wheel side of the liftable forks 5*a* and 5*b* to the sides of the fixing member 2 so as to match with the peripheral surface of the front wheel 72*a*, as is the case of the aforementioned support fork pieces 73*a*. If so modified, the vertical movement and the transfer of the car C can safely be achieved without causing the fore and aft shift of the car C during the vertical movement.

Incidentally, as the entrance warehousing sensor 26 detects the car C, the driver is informed, by means of illumination indication, sound indication, or the like, of the condition that the car C is properly mounted on the stationary driv-in base 71. It is also possible to distribute curvedly the support fork pieces 73*b* corresponding to the rear wheel 72*b*, in place of the support fork pieces 73*a* corresponding to the front wheel 72*a*, on both sides of the stationary drive-in base 71, and provide the entrance warehousing sensor 26 on either side of the stationary drive-in base 71 at a position corresponding to the curved arrangement.

THIRD EMBODIMENT

The different point of a third embodiment from the second embodiment only will now be described.

Figure 40:
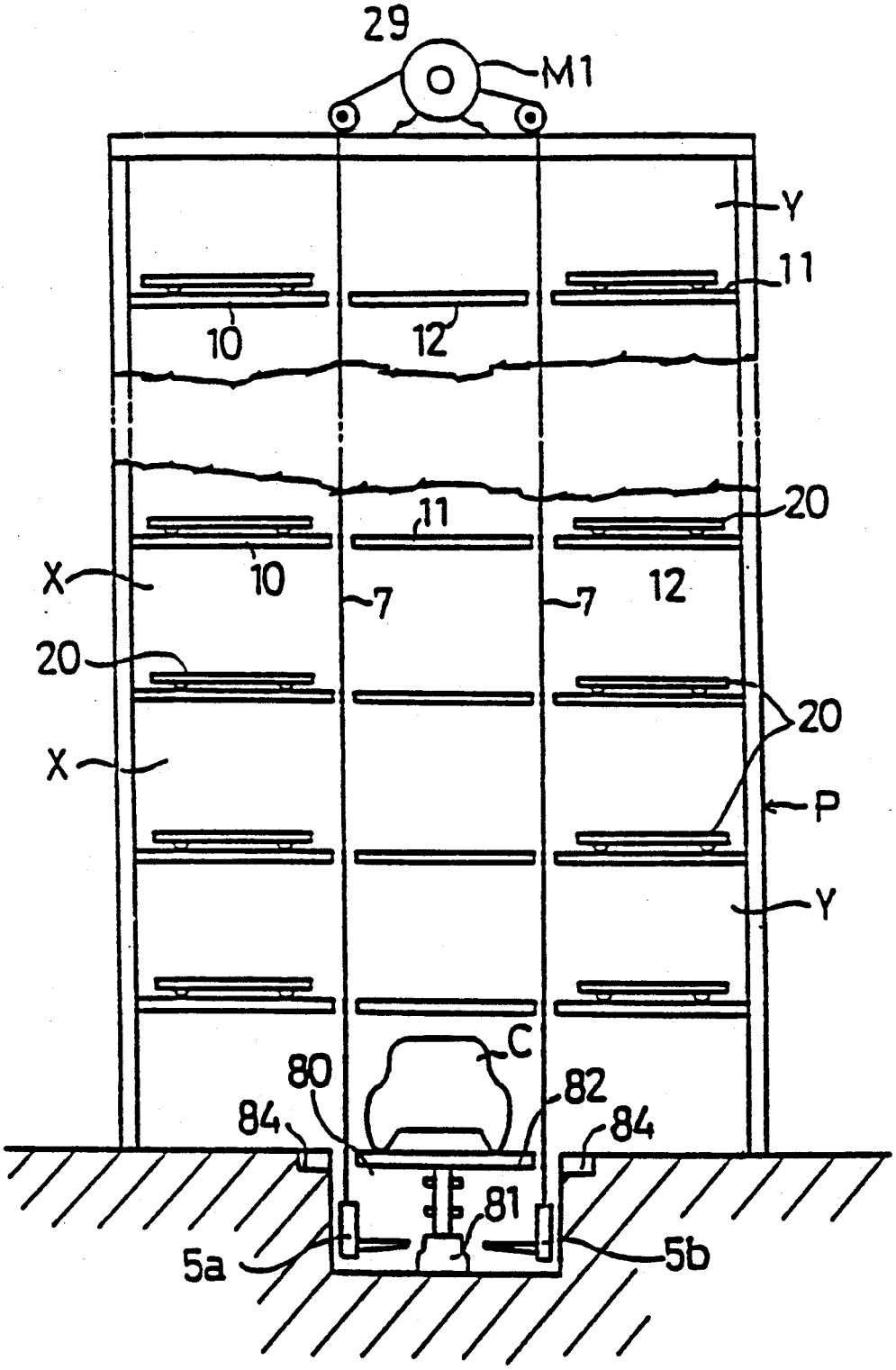
FIG. 40 is a front view showing a third embodiment of the three dimensional housing tower.

Although the second embodiment includes the stationary drive-in base 71 seated on the ground of the drive-in station E1 which is equipped with the support fork pieces 73*a* and 73*b*, according to this third embodiment, as shown in FIG. 40, the ground of the drive-in station E1 is dug down to create a pit 80, and a rotary drive-in base 82 functioning as a turntable is rotatably provided in this pit 80 which is rotated by a motor 81 also provided in the pit 80 while keeping the same level as that of the ground of the drive-in station E1.

The rotary drive-in base 82 has a plurality of support fork pieces projecting from both side surfaces thereof, and the transfer of the car C is achieved by causing these support fork pieces to vertically and alternately intersect with the fork pieces 3 of both liftable forks 5*a* and 5*b*.

Figure 41:
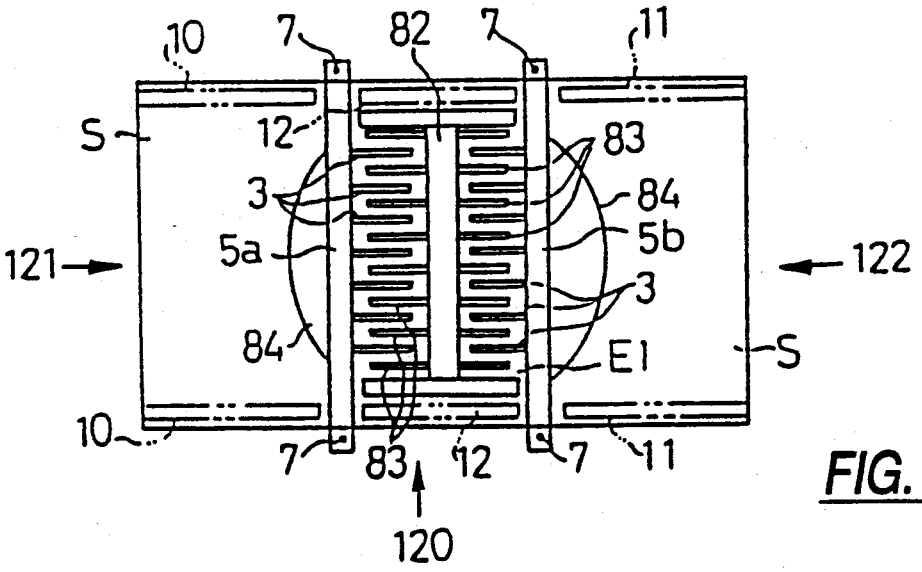
FIG. 41 is a plan view showing an important portion of the above.

In order to prevent the front and rear end sections of the rotary drive-in base 82 from contacting with the ground of the anterooms S provided on both sides of the drive-in station E1 when the base 82 is rotated on the ground of the drive-in station E1, a recess 84 is formed in the ground of each anteroom S on the side of the drive-in station E1 as shown in FIG. 41. Of course, the chains 7 attached to the ends of both liftable forks 5*a* and 5*b* are disposed outside the traverse roller frames 12 in a little spaced relation, for the purpose of avoiding interference with the rotation of the rotary drive-in base 82.

Figure 42:
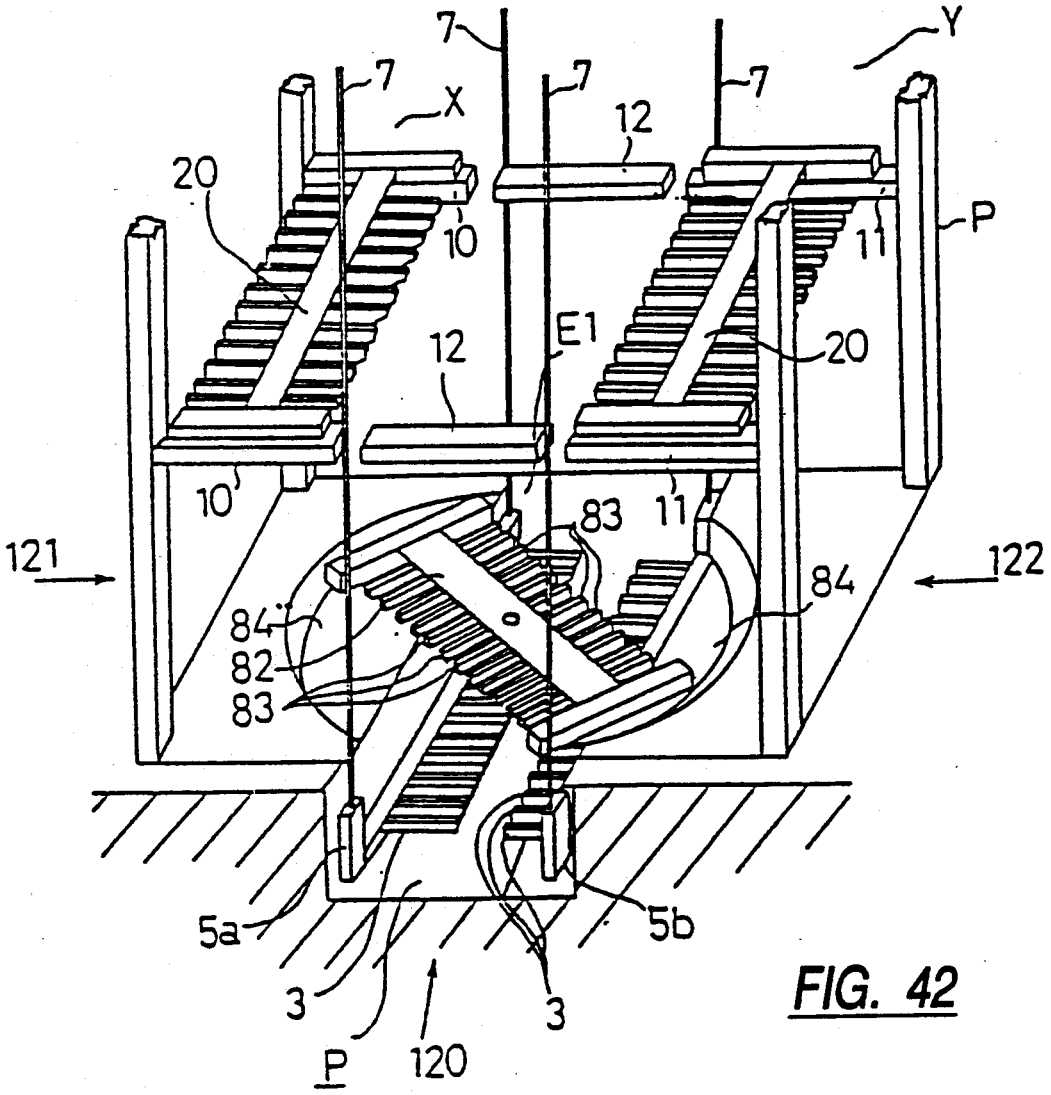
FIG. 42 is a perspective view showing also the important portion of the above.

If so implemented, the front-rear direction of the car C can be changed in the drive-in station E1, after lowering both liftable forks 5*a* and 5*b* with the car mounted thereon into the pit 80 and transferring the car C onto the rotary drive-in base 82, by energizing the motor 81 to turn the rotary drive-in base 82 as shown in FIG. 42.

Figure 43:
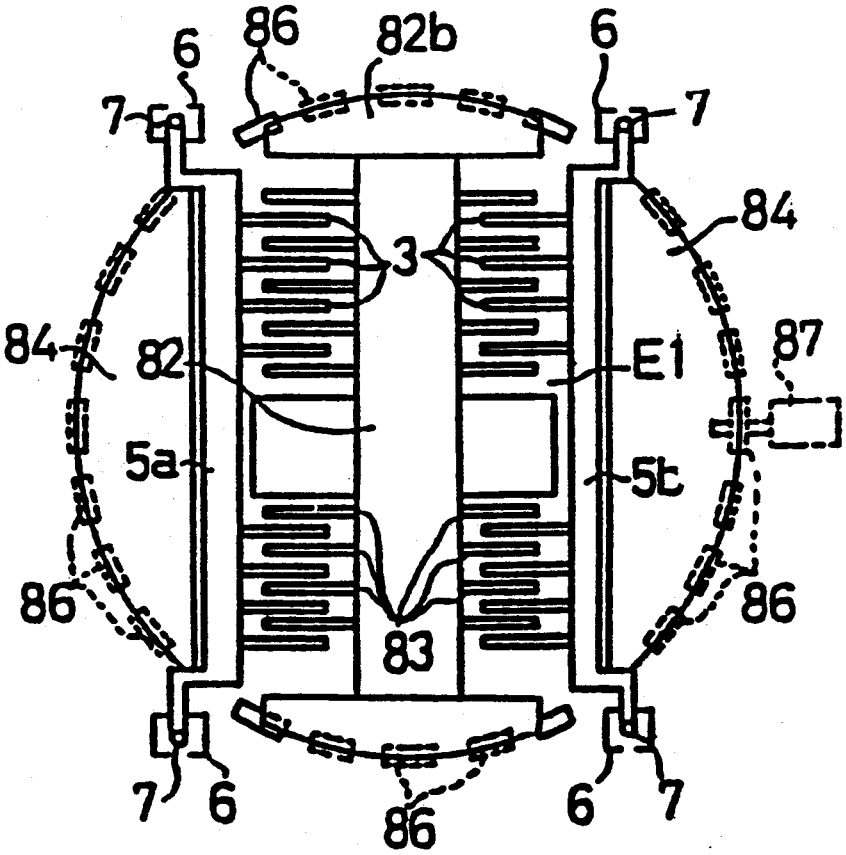
FIG. 43 is a plan view showing a modification of the above.

In this connection, the drive system of the rotary drive-in base 82 may be implemented in such a manner that as shown in FIG. 43, a plurality of rollers 86 are provided on the peripheral surfaces of the recesses 84 which come to face opposite both end sections 82*a* and 82*b* of the rotary drive-in base 82 when the rotary drive-in base 82 is rotated, a roller drive motor 87 is provided in place of the aforementioned motor 81, and both end sections 82*a* and 82*b* of the drive-in base 82 are driven by the rotation of the roller drive motor 87.

Figure 44:
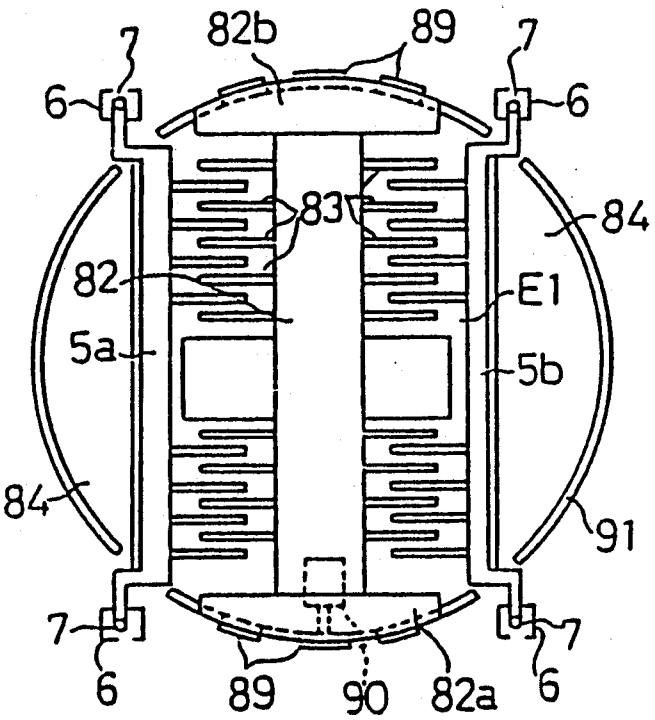
FIG. 44 is a plan view showing another modification of the above.

Further, the drive system of the rotary drive-in base 82 may be implemented in such a manner that as shown in FIG. 44, both end sections 82*a* and 82*b* of the rotary drive-in base 82 are equipped with rollers 89, one end section 82*a* is equipped with a roller drive motor 90 for driving or rotating the rollers 89, guide rails 91 are provided on the peripheral surfaces of the recesses 84 which come to face opposite both end sections 82*a* and 82*b* when the rotary drive-in base 82 is rotated, and the rotary drive-in base is rotated by the roller drive motor 90.

Therefore, according to this third embodiment, at the time of delivery of the car housed in the housing space, X,Y, the direction of the car C can conveniently be changed by rotating the rotary drive-in base 82 on which the car C just lowered into the drive-in station E1 is mounted. Further, the car C can conveniently be driven into the drive-in station E1 as shown in FIG. 42 not only from the front side of the drive-in station E1 (in the direction of the arrow 120), but also from either side of the drive-in station E1 (in the direction of the arrow 121 or 122) depending upon the circumstances of the building site. Furthermore, any additional site other than the building site of the three dimensional housing tower P is not necessary for the turntable of changing the direction of the car C, hence, this embodiment is very effective to improve the efficiency of utilization of the site.

FOURTH EMBODIMENT

The different point of a fourth embodiment from the first embodiment only will now be described.

Figure 45:
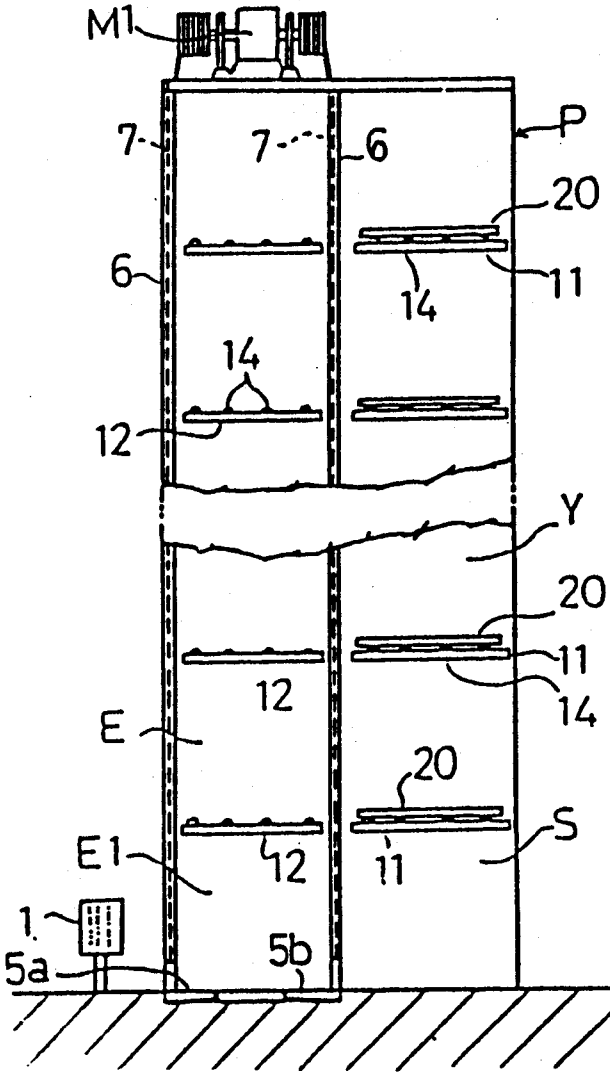
FIG. 45 is a front view showing a fourth embodiment of the three dimensional housing tower.
Figure 46:
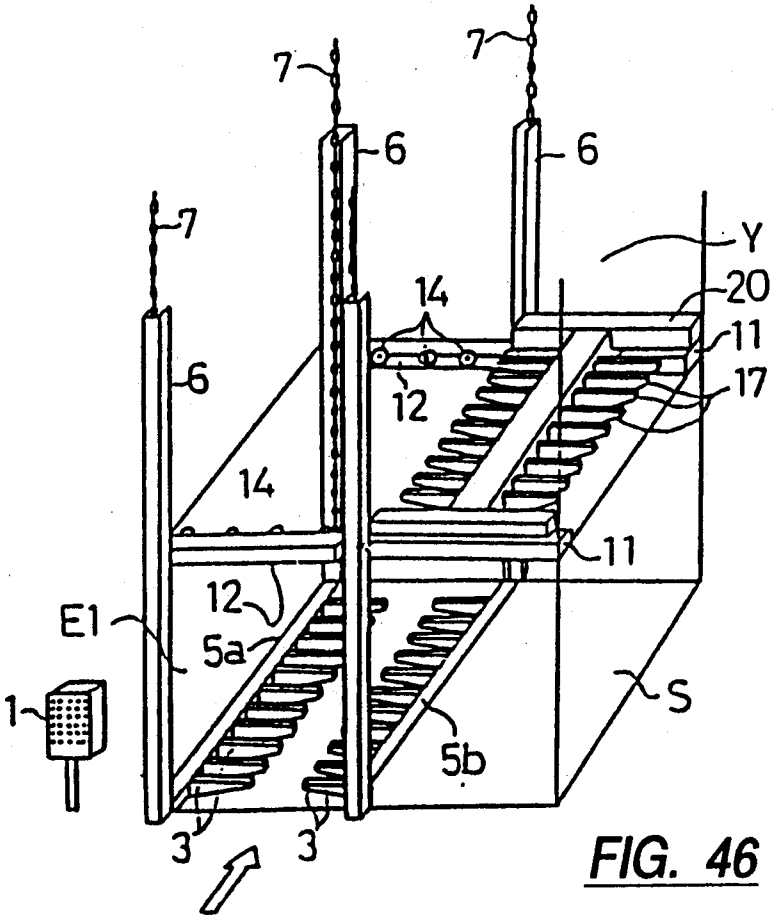
FIG. 46 is a perspective view showing an important portion of the above.

In this fourth embodiment, as shown in FIGS. 45 and 46, the three dimensional housing tower P has only the housing spaces Y provided on the right side of the lift space E, not the left-side housing spaces X and the underground housing spaces.

Accordingly, the three dimensional housing tower P of this fourth embodiment can be built even if the building site therefor is small.

Figure 47:
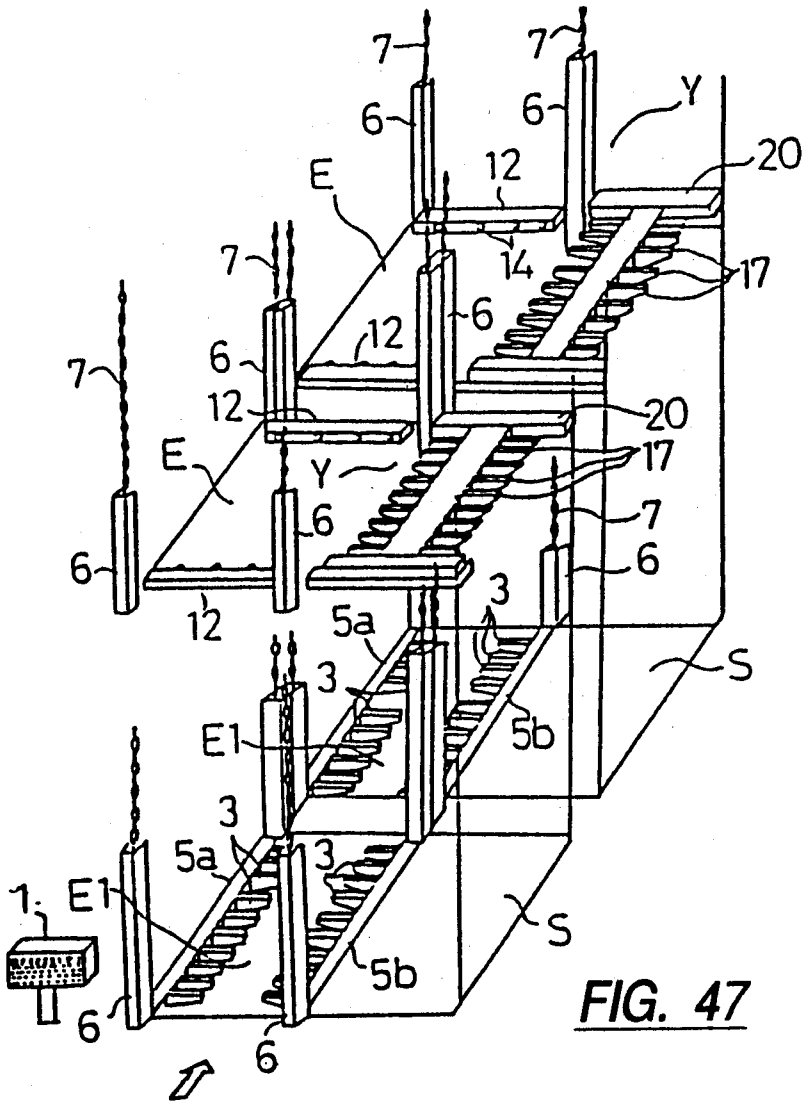
FIG. 47 is a perspective view showing a modification of the forth embodiment.

This fourth embodiment may be modified and implemented in such a manner that as shown in FIG. 47, behind the first row of the lift space E and housing spaces Y are provided additional rows each of a lift space E and housing spaces Y.

This modification utilizes the site more effectively than the aforementioned embodiments.

It is also possible to include only the housing spaces X provided on the left side of the lift space E, or to include the underground housing spaces Y.

FIFTH EMBODIMENT

Figure 49:
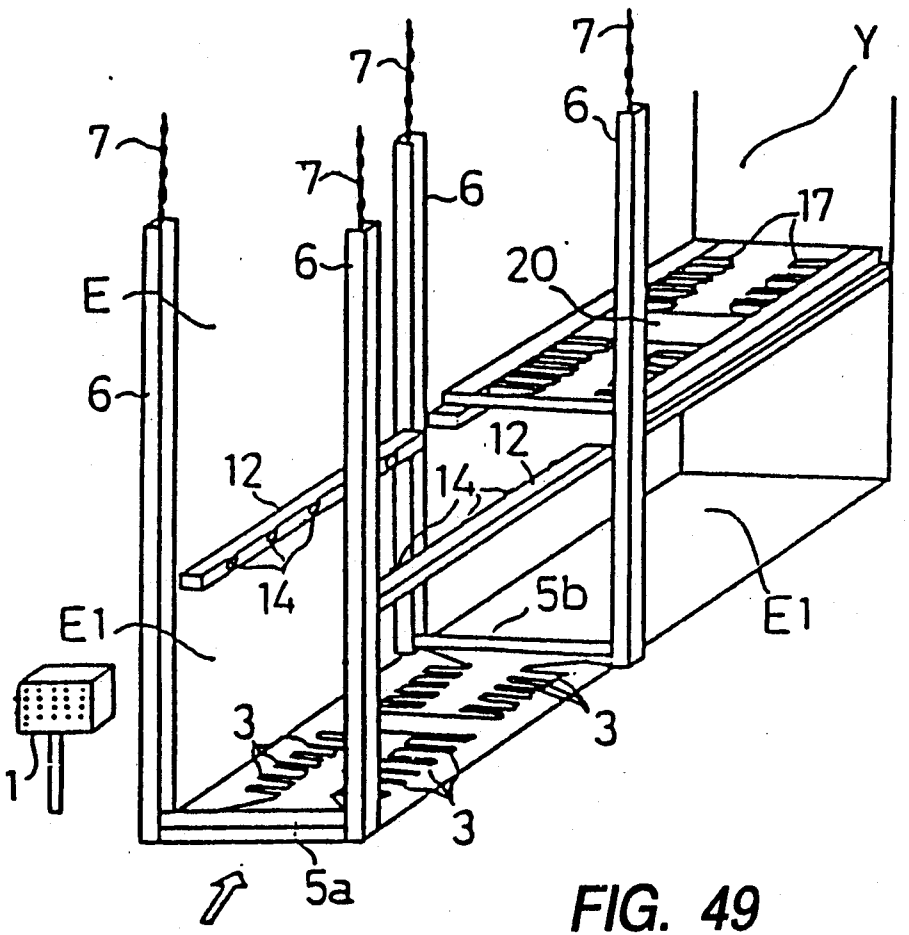
FIG. 49 is a perspective view showing an important portion of the above.
Figure 48:
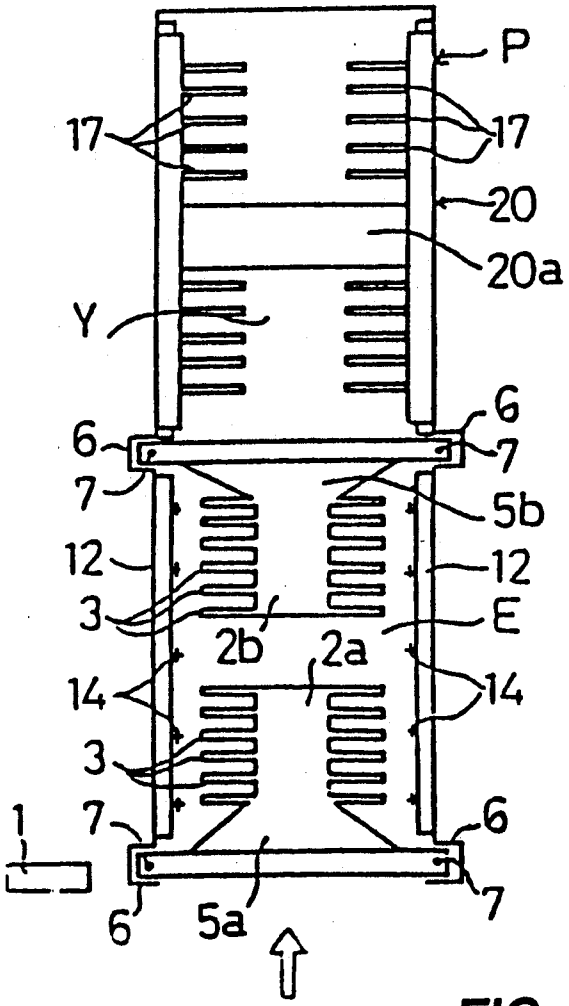
FIG. 48 is a plan view showing a fifth embodiment.
Figure 50:
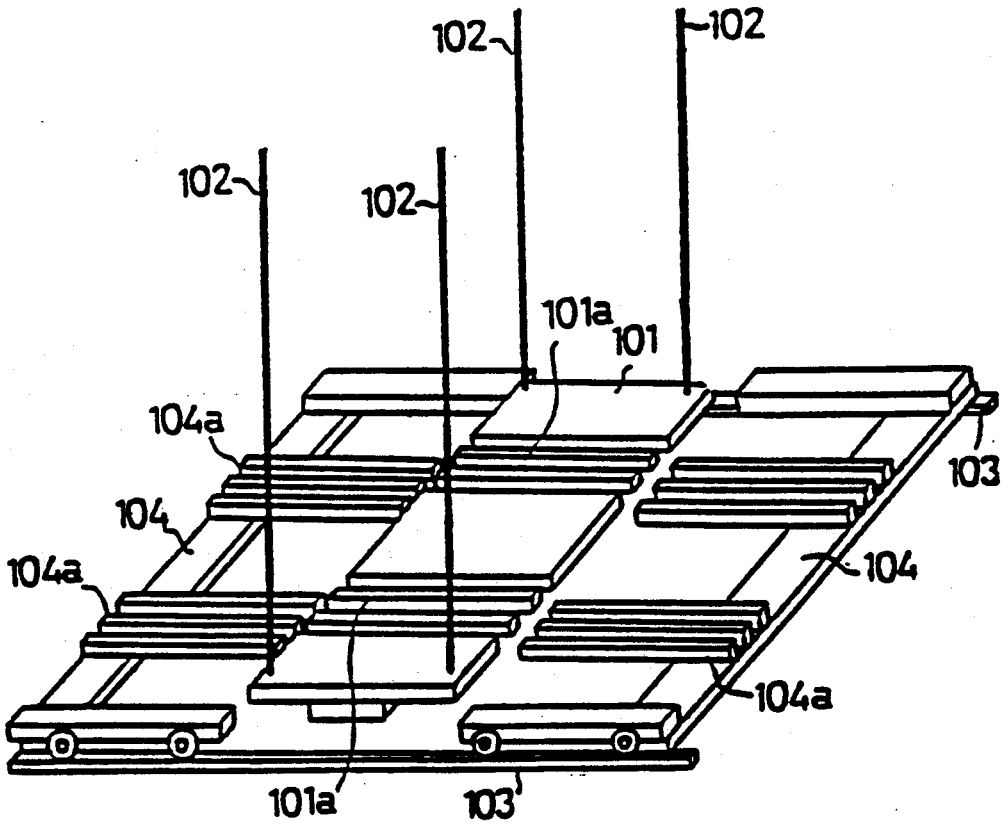
FIG. 50 is a perspective view showing an important portion of a conventional three dimensional housing apparatus.

A fifth embodiment will now be described with reference to FIGS. 48 and 49.

This fifth embodiment corresponds to the modification shown in FIG. 36 of the first embodiment wherein the three dimensional housing tower P includes the lift space E and the housing spacaes X and Y arranged in the front-rear direction. But, this fifth embodiment is implemented without the front-side housing spaces X. That is, differently from the fourth embodiment wherein the three dimensional housing tower P includes only the housing spaces Y provided on the right side of the lift space E, this fifth embodiment is implemented in the form of a three dimensional housing tower P including only the housing spaces Y provided behind the lift space E.

Therefore, according to this fifth embodiment, the three dimensional housing tower P can be built even if the width of the building site in the widthwise direction of the tower P is narrow.

While the preferred embodiments have been described, it is not intended to have the present invention limited to the specific embodiments thereof, and many changes and modifications may be made without departing from the spirit of the present invention.

What is claimed is:

1. A method for controlling a vehicle parking structure comprising a lift space including a loading position for receiving the vehicle, a liftable fork unit movable up and down in the lift space, multi-storied housing spaces abutting at least one side out of a left side, right side, front side and rear side of the lift space, and a plurality of traversable housing forks each mounted movably in the horizontally opposed directions between one of the housing spaces and the lift space, wherein each traversable housing fork and the liftable fork unit are intersectable to each other at a predetermined point to transfer the vehicle to be housed therebetween, an improvement comprising:

warehousing the vehicle in the housing space above the loading position wherein the liftable fork unit is moved in one of the vertically opposed directions and the traversable housing fork is moved in one of the horizontally opposed directions;

delivering the vehicle from the housing space to the lift space wherein the liftable fork unit and traversable housing fork are moved in the reverse directions to the directions in the warehousing step;

detecting when the traversable housing fork fails to reach the predetermined point earlier than the liftable fork unit; and stopping the liftable fork unit immediately before the predetermined point in accordance with the result of the detecting step in the event of a malfunction of the traversable housing fork.

2. A method as set forth in claim 1 further comprising the steps of;

detecting that the liftable fork unit is in the loading position;

sensing the presence/absence of the vehicle on the liftable fork unit; and indicating a housing state in each housing space.

3. A method as set forth in claim 2, wherein the presence/absence of the vehicle in each housing space is judged on the basis of a memory unit which stores data in the warehousing step and deletes stored data in the delivery step.

4. A method as set forth in claim 2, wherein a warehousing operation is started on condition that the vehicle exists on the liftable fork unit in the loading position.

5. A method as set forth in claim 2, wherein a delivery operation is started on condition that no vehicle exists on the liftable fork unit in the loading position.

6. A method as set forth in claim 1, which includes the steps of:

sensing a completion of the delivering of a vehicle; and starting to deliver a next vehicle before a return of the liftable fork unit to the loading position.

* * * * *